US007520587B2

(12) United States Patent
Takeuchi

(10) Patent No.: US 7,520,587 B2
(45) Date of Patent: Apr. 21, 2009

(54) IMAGE RECORDING APPARATUS

(75) Inventor: Masaru Takeuchi, Handa (JP)

(73) Assignee: Brother Kogyo Kabushiki Kaisa, Nagoya-shi, Aichi-ken (JP)

( * ) Notice: Subject to any disclaimer, the term of this patent is extended or adjusted under 35 U.S.C. 154(b) by 357 days.

(21) Appl. No.: 11/442,234

(22) Filed: May 30, 2006

(65) Prior Publication Data

US 2006/0268292 A1 Nov. 30, 2006

(30) Foreign Application Priority Data

May 30, 2005 (JP) ..... 2005-156937
Jun. 30, 2005 (JP) ..... 2005-192143

(51) Int. Cl.
*B41J 2/165* (2006.01)
*B41J 2/01* (2006.01)

(52) U.S. Cl. ..... 347/23; 347/22; 347/104

(58) Field of Classification Search ..... 347/22, 347/23, 24, 29, 30, 32, 33, 35, 36, 104
See application file for complete search history.

(56) References Cited

FOREIGN PATENT DOCUMENTS

| | | | |
|---|---|---|---|
| JP | S61-032778 | A | 2/1986 |
| JP | H09-183547 | A | 7/1997 |
| JP | H9295412 | | 11/1997 |
| JP | H10-157227 | A | 6/1998 |
| JP | 2622674 | B2 | 9/1998 |
| JP | 19982833874 | | 9/1998 |
| JP | 2002128351 | | 5/2002 |
| JP | 2004-284184 | A | 10/2004 |

OTHER PUBLICATIONS

Japanese Patent Office, Notice of Reasons for Rejection in Japanese Patent Appl'n No. 2005-156937 (counterpart to above-captioned U.S. patent application), mailed Oct. 15, 2008.

*Primary Examiner*—Shih-Wen Hsieh
(74) *Attorney, Agent, or Firm*—Baker Botts L.L.P.

(57) ABSTRACT

There is provided an image recording apparatus which includes a head; a carriage capable of reciprocating in a main scanning direction of a paper; a maintenance section of the recording head; a pair of rollers for transporting the paper; and a motor for driving the maintenance section and the pair of rollers; and in which when the carriage is at a maintenance position, the rollers in the pair are separated away from each other. Accordingly, it is possible to reduce an electric power consumption of the motor during the maintenance work, and to reduce noise generated from the pair of rollers at the time of maintenance.

17 Claims, 16 Drawing Sheets

IMAGE RECORDING APPARATUS

CROSS REFERENCE TO RELATED APPLICATION

The present application claims priority from Japanese Patent Applications No. 2005-156937, filed on May 30, 2005, and No. 2005-192143, filed on Jun. 30, 2005, the disclosures of which are incorporated herein by reference in its entirety.

BACKGROUND OF THE INVENTION

1. Field of the Invention

The present invention relates to an image recording apparatus which is capable of recoding an image on a paper.

2. Description of the Related Art

In recent years, in an image recording apparatus of ink-jet type which includes a recording head on a lower surface of a carriage capable of reciprocating in a main scanning direction, and a transporting unit (paper feeder) transporting (carrying) a paper (recording medium) in a secondary scanning direction, that is orthogonal to the main scanning direction, along a lower surface of the recording head, and which is capable of recoding (printing) an image on the paper, the transporting unit includes a pair of resist rollers provided on an upstream side in the secondary scanning direction (transporting direction), sandwiching a carriage, and a paper discharging mechanism which is provided on a downstream side in the secondary scanning direction and which discharges the paper after recording an image thereon.

Further, as disclosed in Japanese Patent Application Laid-open No. 9-295412 (see FIG. 2) for example, the image recording apparatus is hitherto simplified by adopting a structure which includes a maintenance section at one of end portions in the main scanning direction, and a maintenance section, a transporting mechanism (resist rollers), and a paper discharging mechanism (paper discharging roller mechanism) are rotated and driven by one common drive motor (driving source).

Furthermore, as disclosed in Japanese Patent Application Laid-open No. 9-295412, for preventing a load of the common drive motor to be excessive at a time of performing the maintenance, the image recording apparatus is structured such that while motive power from the common drive motor is transmitted all the time to a transporting unit via a train (row) of gears, the motive power is transmitted selectively to the maintenance section via a clutch mechanism. In this structure, at a time of start of the maintenance, when a paper is left (remained) in the transporting unit, firstly, only the transporting unit is driven, and the paper is discharged. Then, the carriage is moved to the maintenance section, and the clutch is switched such that the motive power is transmitted to the maintenance section.

Further, for example, as disclosed in Japanese Patent Application Laid-open No. 2002-128351 (see FIG. 2), in a paper discharging mechanism, drive rollers which are in contact with the lower surface of a paper, and are driven and rotated in a direction of paper discharge, and a plurality of spurs are provided with a bias applied (force imparted) on each of the spurs towards the drive rollers respectively. The spurs are in contact with a surface (upper surface) of the paper on which an image has been recorded, and rotates upon being driven by the discharge operation of the paper. Furthermore, a structure in which the transporting mechanism and the paper discharging mechanism are rotated and driven by one drive motor (driving source) has been common.

According to the above-mentioned structure, each of the spurs has a large number of teeth on a peripheral line (edge) thereof, and a front tip of each of the teeth makes a so-called point-to-point contact with an image-recording surface of the paper. Therefore, even when the spurs make a contact with the paper immediately after the image has been recorded, there is an advantage that there is little fear of dirtying the paper recording surface, and/or damaging a formed image.

SUMMARY OF THE INVENTION

However, in a structure as described in Japanese Patent Application Laid-open No. 9-295412, there are following disadvantages. One of the disadvantages is that, in the transporting unit, particularly in a pair of resist rollers on the upstream side, a driven roller is always pressed against a drive roller driven by the common drive motor. Therefore, since a resistance by a pressing force is substantial, when the transporting unit and the maintenance section are driven simultaneously by the common drive motor, power consumption (energy consumption) of the motor is increased. Second disadvantage is that since the driven roller is always pressed against the drive roller, for example, even during transporting a paper from a paper feeding cassette up to a position below a recording head, and during a maintenance work, a rubbing (squeaking) sound is generated when the driven roller makes a contact with the drive roller, and this rubbing sound becomes a noise.

Furthermore, in a structure as described in Japanese Patent Application Laid-open No. 2002-128351, there are the following disadvantages. In an image recording apparatus adopting a structure in which both the transporting unit and the paper discharging mechanism are being driven simultaneously, and motive power is transmitted from the transporting mechanism to the paper discharging mechanism, when a paper discharging roller is rotated and driven in a state that a spur makes a contact with the paper discharging roller all the time, for example, even during transporting a paper from the paper feeding cassette up to a position below the recording head, and during the maintenance work, the paper discharging roller are rotating, and a rubbing sound is generated when a peripheral edge of the spur comes in contact with the paper discharging roller to be driven, and thus this rubbing sound becomes a noise.

The present invention is made to solve the above-mentioned problems with the conventional image recording apparatus, and an object of the present invention is to provide an image recording apparatus which reduces the occurrence of noise by decreasing the energy consumption, during the maintenance work.

According to a first aspect of the present invention, there is provided an image recording apparatus which records an image on a recording medium, the image recording apparatus including:

an image recording section having a recording head, and a carriage to which the recording head is provided and which is movable in a predetermined direction;

a maintenance section which performs a maintenance of the recording head;

a first roller which is driven, and a second roller which is arranged facing the first roller and which transports the recording medium by nipping the recording medium between the first roller and the second roller;

an adjustment mechanism which adjusts a pressing force exerted by the second roller on the first roller; and a motor which commonly drives the first roller and the maintenance section;

wherein when the motor drives the maintenance section, the adjustment mechanism reduces the pressing force of the second roller exerted on the first roller.

According to the first aspect of the present invention, when the carriage is positioned in the maintenance section, and when the maintenance section is performing the maintenance (such as removing solidified ink) of the recording head, the pressing force between the first roller and the second roller is reduced. Therefore, the noise generated due to the contact between the rollers is reduced.

The image recording apparatus of the present invention may further include:

a feeding roller which is driven by the motor and which feeds the recording medium by separating the recording medium from another recording medium; and a motive-power transmission-switching mechanism which transmits a motive power of the motor by switching the motive power to one of the feeding roller and the maintenance section. In this case, the motive power is used by being alternately switched between the maintenance section and the feeding roller. Accordingly, when the maintenance section is driven, the feeding roller is stopped. Therefore, the noise during the maintenance work can be reduced.

According to a second aspect of the present invention, there is provided an image recording apparatus which records an image on a recording medium, the image recording apparatus including:

a supplying section which supplies the recording medium;

an image recording section having a recording head, and a carriage to which the recording head is provided and which is movable in a predetermined direction;

a maintenance section which performs a maintenance of the recording head; and a transporting mechanism which transports the recording medium transported from the paper supplying section to the image recording section, the transporting mechanism including:

a pair of resist rollers including a drive roller and a driven roller; a bias-applying unit (force imparting unit) which presses the driven roller against the drive roller; a common drive motor which drives the drive roller and the maintenance section; and an actuator which separates the driven roller away from the drive roller, or which weakens a pressing force of the driven roller against the drive roller;

wherein when the carriage is positioned at the maintenance section, and when the maintenance section is performing the maintenance of the recording head, the actuator is driven to separate the driven roller away from the drive roller, or to weaken the pressing force of the driven roller against the drive roller.

According to the second aspect of the present invention, when the carriage is positioned at the maintenance section, and when the maintenance work is performed, the actuator is activated (operated) to be ON such that the driven roller is separated away from the drive roller, or the pressing force of the driven roller exerted on the drive roller is weakened. Therefore, a noise such as the noise, generated when the driven roller is rotated while being pressed strongly against the drive roller, is not generated, and the maintenance can be performed quietly. Furthermore, a rotational resistance such as a resistance generated when the driven roller is rotated while being pressed strongly against the drive roller is not generated. Accordingly, the power consumption (energy consumption) of the common drive motor is also reduced.

The image recording apparatus of the present invention may further include a roller holder which holds the driven roller, wherein the actuator may make the roller holder move to separate the driven roller away from the drive roller, or to weaken the pressing force of the driven roller against the drive roller.

In this case, the structure is adopted such that the driven roller is attached (fixed) to the roller holder, and that the actuator makes the roller holder move to separate the driven roller away from the drive roller, or to weaken the pressing force. Accordingly, a mode for controlling the actuator becomes extremely simple.

The image recording apparatus of the present invention may further include a control unit which controls the actuator. In this case, for example, by using a control unit which has a memory which stores a program related to the control, and a CPU (central processing unit) which executes the program, it is possible to automate the control of the actuator according to a pre-programmed control content.

In the image recording apparatus of the present invention, the actuator may be inactive when the carriage is moved from the maintenance section to an image recording area at which the image recording section performs a recording of the image.

In this case, by performing control such that the actuator is not activated (not activated to be ON) when the carriage is moved from the maintenance section to the image recording area, a resist action and a paper feeding can be performed automatically at a time of image recording job.

In the image recording apparatus of the present invention, a pair of paper discharging rollers including a paper discharging roller may be arranged on a downstream side of the carriage in a transporting direction of the recording medium; and the drive roller of the pair of resist rollers and the paper discharging roller of the pair of paper discharging rollers may be rotated and driven in a same direction by the common drive motor.

In this case, a pair of resist rollers is arranged on the upstream side of the carriage, in the transporting direction of the recording medium, and a pair of paper discharging rollers is arranged on the downstream side of the carriage in the transporting direction of the recording medium. The pair of the resist rollers and the pair of the paper discharging rollers are rotated and driven in a same direction by one common drive motor, thereby simplifying the structure for transporting the paper.

The image recording apparatus of the present invention may further include:

a feeding roller which is driven by the common drive motor and which feeds the recording medium by separating the recording medium from another recording medium; and a motive-power transmission-switching mechanism which transmits a motive power of the common drive motor by switching the motive power to one of the feeding roller and the maintenance section. In this case, since the feeding roller is not driven at the time of maintenance, it is possible to reduce a noise caused due to the driving of the feeding roller.

According to a third aspect of the present invention, there is provided an image recording apparatus which records an image on a recording medium, the image recording apparatus including:

an image recording section having a recording head, and a carriage to which the recording head is provided and which is movable in a direction intersecting a transportation direction in which the recording medium is transported; a maintenance section which performs a maintenance of the recording head; and a paper discharging mechanism which is arranged on an downstream side of the carriage in the transporting direction of the recording medium and which holds the recording medium and transports the recording medium in the transporting direction, the paper discharging mechanism including:

a paper discharging roller which is driven; a spur which is arranged to face the paper discharging roller and which is capable of making a contact with the paper discharging roller; a spur holder which supports the spur and which is provided to be movable away from and closer to the paper discharging roller; and a moving unit which moves the spur holder in a direction such that the spur is separated away from the paper discharging roller, when the carriage is positioned at the maintenance section.

According to the third aspect of the present invention, the apparatus is provided with the moving unit which moves the spur holder in the direction such that the spur is separated away from the paper discharging roller, when the carriage is positioned at the maintenance section. Therefore, when the maintenance section is performing the maintenance of the recording head, the spur does not make a contact with the paper discharging roller which is rotating. Therefore, the noise, which would be otherwise generated due to a rubbing sound generated when an outer peripheral edge of the spur is driven while making a contact with the paper discharging roller, is not generated, and thus the maintenance work can be performed quietly.

In the image recording apparatus of the present invention, the moving unit may be a cam mechanism which is interposed between the spur holder and a supporting frame which guides and supports the carriage.

In the image recording apparatus of the present invention, the carriage may include a contact section; and the cam mechanism may include a cam section and a lever which makes a contact with the contact section of the carriage and tilts the cam section, when the carriage is positioned at the maintenance section.

In such cases, by a simple operation of merely moving the carriage to the maintenance section, the spur holder is moved in a direction in which the spur holder is separated away from the paper discharging roller. Therefore, when the maintenance section performs the maintenance of the recording head, there is no noise which would be otherwise generated by the contact between the spur and the paper discharging roller, and thus the maintenance can be performed quietly.

In the image recording apparatus of the present invention, the moving unit may be an actuator which makes the spur holder to move away from the paper discharging roller, when the carriage is positioned at the maintenance section.

In this case, when the carriage is positioned at the maintenance section, a position of the carriage is detected by, for example, a switch or a sensor (a contact-type sensor, or a non-contact type sensor such as an optical sensor), and the spur holder can be moved to away from the paper discharging roller by using an actuator such as an electromagnetic solenoid. When such structure is adopted, the number of parts or components can be reduced.

In the image recording apparatus of the present invention, when the carriage is moved from the maintenance section to an image recording area at which the image recording section performs a recording of the image, the moving unit may move the spur holder in a direction such that the spur makes a contact with the paper discharging roller.

In this case, at the time of an image recording job, the spur and the paper discharging roller can automatically nip (hold) the recording medium which is to be discharged, thereby simplifying the control of the movement of the spur holder.

The image recording apparatus of the present invention may further include: a motor; and a pair of resist rollers arranged on an upstream side of the carriage in the transportation direction of the recording medium, and including a drive roller and a driven roller; wherein both of the drive roller and the paper discharging roller may be driven by the motor.

In this case, the drive roller of the pair of resist rollers, and the paper feeding roller of the pair of paper feeding rollers are rotated and driven in a same direction by one drive motor for transporting the paper. Therefore, a structure for transporting the paper becomes simple.

The image recording apparatus of the present invention may further include an actuator which separates the driven roller away from the drive roller, or weakens a pressing force of the driven roller against the drive roller; wherein when the carriage is positioned at the maintenance section and when a maintenance is performed, the actuator may be driven to separate the driven roller away from the drive roller, or to weaken the pressing force of the driven roller against the drive roller. In this case, the image recording apparatus includes, in addition to the mechanism to adjust the pressing force of the pair of paper discharging rollers, the mechanism which adjusts the pressing force of the pair of resist rollers. Therefore, it is possible to reduce the noise generated when the maintenance section performs the maintenance.

In the image recording apparatus of the present invention, the maintenance section may also be driven by the motor; and the image recording apparatus may further include: a feeding roller which is driven by the motor and which feeds the recording medium by separating the recording medium from another recording medium; and a motive-power transmission switching mechanism which transmits the motive power by switching the motive power to one of the feeding roller and the maintenance section.

In this case, since several units can be driven by one motor, the number of parts or components of the image recording apparatus can be decreased. Further, since the feeding roller is not driven during the maintenance work, the noise at the time of maintenance can be reduced.

In this application, the term "image" includes not only an image, but also information such as a letter or character.

DETAILED DESCRIPTION OF THE PREFERRED EMBODIMENTS

Figure 1:
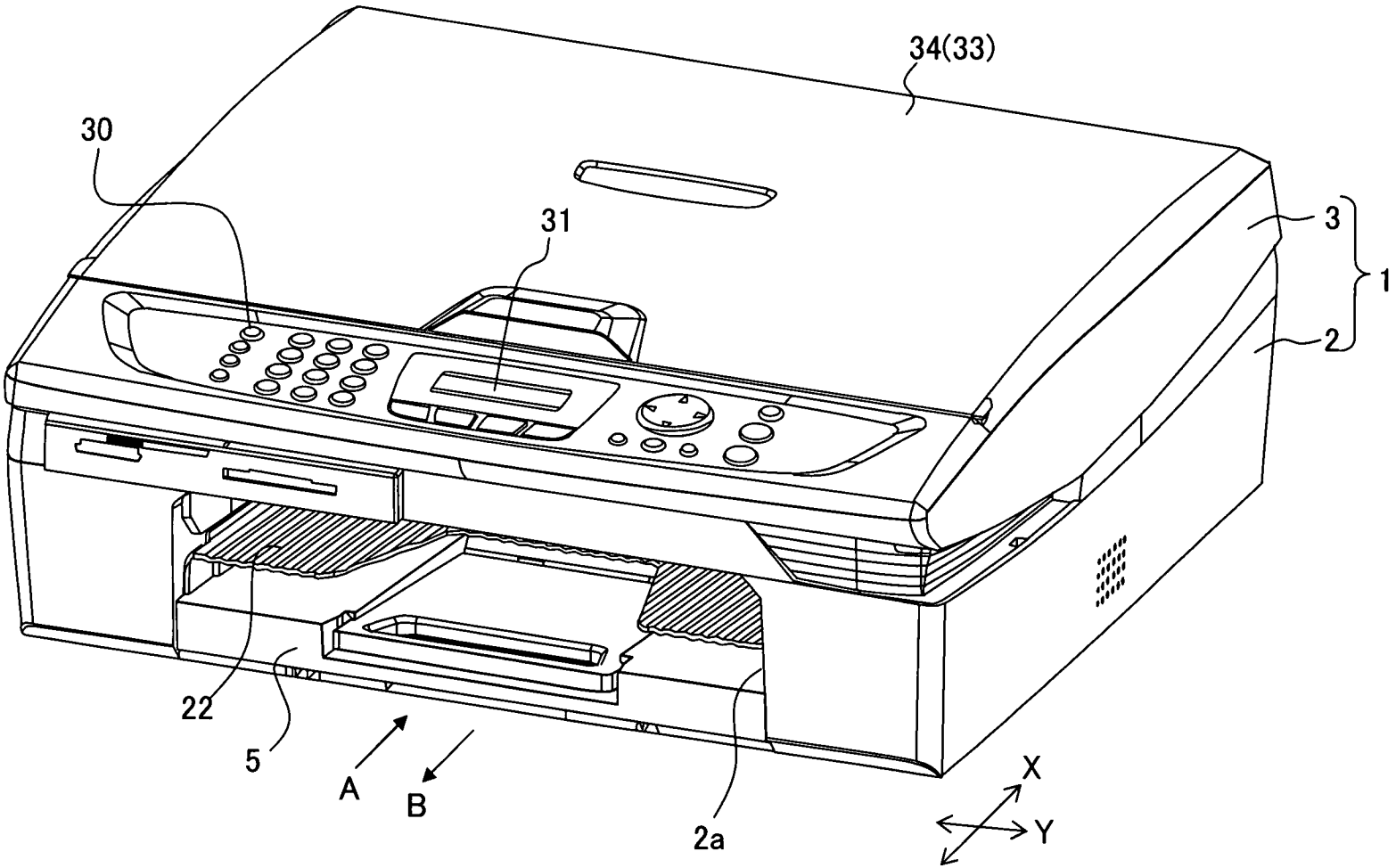
FIG. 1 is an overall perspective view of an image recording apparatus.

Embodiments in which the present invention is embodied will be described in detail with reference to drawings. An image recording apparatus 1, which is shown in FIG. 1 and is a multi function device, is provided with functions such as a facsimile function, a printer function, a copier function, and a scanner function. The image recording apparatus 1 includes a case 2 of the apparatus body that is substantially box-shaped in which an upper surface thereof is opened, and an upper case 3 which is rotatably connected to one side (left side in FIG. 1) of the case 2, such that the upper case 3 is rotatable upwardly and downwardly, via a rotating section (not shown in the diagram) such as a hinge and a hinge section, with respect to one side of the case 2. In the following explanation, a frontward side of the image recording apparatus 1 in FIG. 1 is a front side, and with respect to a left and right direction (main scanning direction, Y axis direction), frontward and rearward direction (secondary scanning direction, X axis direction), and a vertical (up and down) direction, the description is based on a direction in which the image recording apparatus 1 is oriented in FIG. 1 as a reference. The case 2 of the apparatus main body and the upper case 3 are injection-molded cases made of a synthetic resin.

As shown in FIG. 1, an operation panel 30 is arranged in a front portion of the upper surface of the upper case 3. The operation panel 30 is provided with various buttons such as number buttons, a start button, functional operation buttons. By pressing these buttons, various operations are performed. A display section 31 such as a liquid crystal display (LCD) is provided on the operation panel 30. A setting condition of the image recording unit 1 and various operation messages are displayed as required.

In the upper case 3, a scanner unit (image reading section) 33 is arranged on a portion on a rear side of the operation panel 30. In other words, the scanner unit 33 for reading a facsimile document which is to be sent to other facsimile unit when the facsimile function is performed, and an image on a document which is to be copied when the copier function is performed, includes a flat-bed reading section which reads an image on a document on a large size glass plate, and a cover body 34 which is rotatable and which covers the upper surface of the flat-bed reading section. The cover body 34 is supportably provided to be openable and closable via a hinge, with a rear surface side (far side in FIG. 1) of the image recording apparatus 1 as the center of the rotation.

Although it is not shown in the diagram, a contact image sensor (CIS) 36 in the form of a line, which is an opto-electric converting element (device) for reading an image surface of a document allowed to make a contact with the glass plate is provided directly below the glass plate in the flat-bet reading section, along a guide axis which is extended in a direction (secondary scanning direction, X axis direction) orthogonal to a moving direction (main scanning direction, Y axis direction) of the carriage which will be described later, such that the contact image sensor 36 is capable of reciprocating along the moving direction of the carriage.

Further, the upper case 3 can be opened widely upward relative to the case 2 of the apparatus body, with a left side end portion in FIG. 1 as the center. As a holding mechanism for holding the upper case 3 in opened state or posture, a supporting rod (not shown in the diagram) and a guide rail (not shown in the diagram) which is extended in parallel to a moving direction of the image sensor 36 are provided on one side (rear surface side of the image recording apparatus 1) of a lower surface side of the upper case 3. This holding mechanism is a mechanism in which one end of the supporting rod is rotatably connected on a side far away from the rotating section of the case 2 of the apparatus body, and a guide pin formed in the other end of the supporting rod is movably inserted to the guide rail. Further, by fixing the guide pin to an engaging portion in the form of a notch (not shown in the diagram) formed in the guide rail, the upper case 3 can be held in an opened state at a predetermined wide angel with respect to the case 2 of the apparatus body.

Next, the structure of a printer unit (recording section) will be explained. As shown in FIG. 1, a paper feeding cassette 5 is arranged at a central portion in a left and right direction in the case 2 of the apparatus body. The paper feeding cassette 5 is provided such that the paper feeding cassette 5 can be drawn out with respect to an opening 2*a* in a front surface of the case 2 of the apparatus body. On a bottom portion of the paper feeding cassette 5, a plurality of papers P can be placed and piled up (stacked) in a substantially horizontal manner. Further, on an upper portion of the paper feeding cassette 5, a paper discharging section 22 for discharging the paper onto which recording has been performed is provided.

Figure 2:
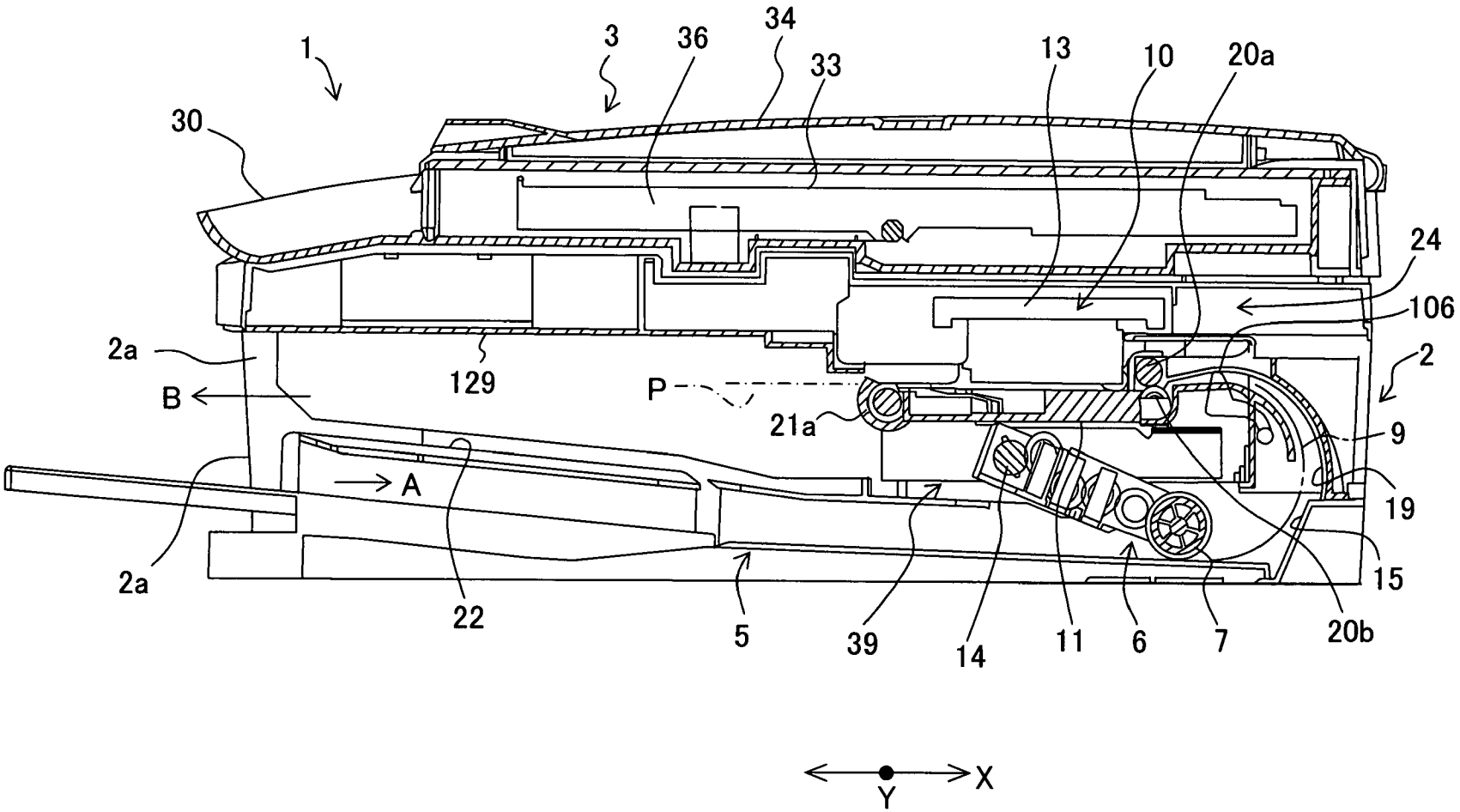
FIG. 2 is a side cross-sectional view of the image recording apparatus.
Figure 3:
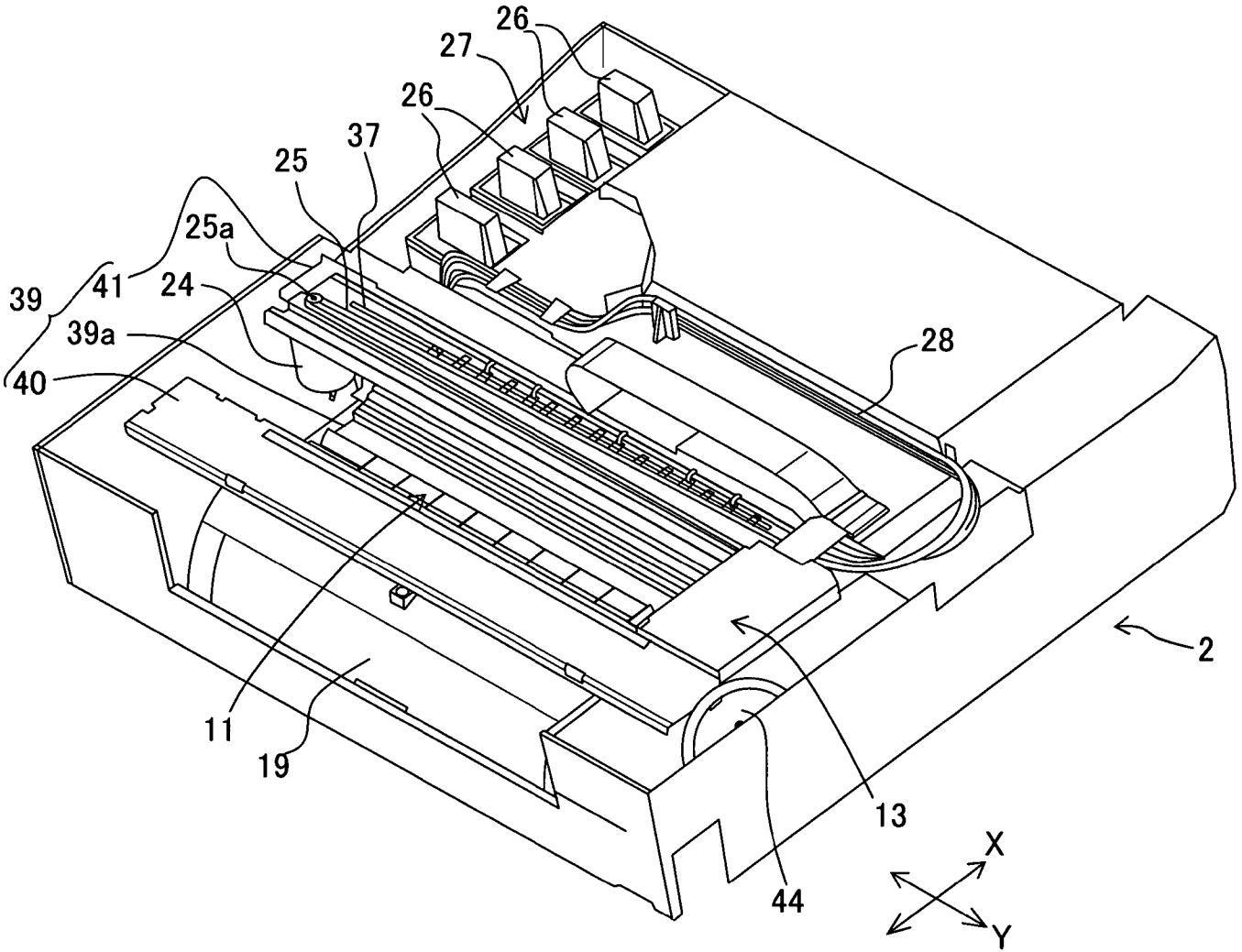
FIG. 3 is a perspective view of a case for the apparatus body in which an upper case is omitted, as viewed from a rear side.

Furthermore, in the case 2 of the apparatus body, a transporting path, an accommodating section 27 which accommodates ink cartridges 26, a feeding unit 6, and a recording unit 10 are arranged (see FIGS. 2 and 3). These parts or components will be explained in the following one by one. The transporting path transports the paper P in a forward direction in a substantially horizontal state, via a U-turn transporting channel 9 which makes a U-turn upwardly at a rear end portion in the case 2 of the apparatus body. Further, the recording unit 10 includes a recording head 12 of an ink-jet type which records an image or the like by discharging ink onto a surface of the paper P transported on a platen 11 which is a paper supporting section in the form of a flat plate arranged in the transporting path.

The ink cartridges 26 for supplying the ink to the recording head 12 for color recording are configured to be detachably connectable from an upper side with respect to the accommodating section 27 (see FIG. 3). The accommodating section 27 is disposed at a position close to an inner surface of a side surface plate of the case 2 of the apparatus body, the side surface plate facing the other side surface plate having the rotating section and being at a position separated the farthest away from the other side surface plate having the rotating section. Inks of a plurality of colors are accommodated in the ink cartridges 26 respectively, with ink of one color being in one of the ink cartridges 26. In this embodiment, the ink cartridges 26 containing ink of four colors, namely black, cyan, magenta, and yellow respectively are accommodated in the accommodating section 27. Inks of multiple colors not less than four colors may be accommodated in the accommodating section 27. The ink is supplied from each of the ink cartridges 26 to the recording head 12 by connecting an ink tube 28 having flexibility to the recording head 12.

Next, the feeding unit 6 will be explained. The feeding unit 6 includes a drive shaft 14, an arm 6*a*, and a paper feeding roller (feeding roller) 7. The arm 6*a* of the feeding unit 6 is rotatably arranged by the drive shaft 14 to a body section 39*a* of an engine frame 39 which will be described later (see FIGS. 2 and 11). As will be described later in detail, a driving force of the feeding unit 6 is supplied, from an LF motor 42 of a transporting mechanism 300 of the recording unit 10, via a motive-power transmission switching mechanism 100 of a maintenance section 36. A bias is applied on (force is imparted to) the arm 6*a* all the time in an upward direction of rotation by a bias-applying (force imparting) mechanism such as a torsion spring which is not shown in the diagram. Here, when the paper P is separated from another paper P and the papers are fed one by one from the paper feeding cassette 5, the LF motor 42 is rotated in reverse direction, thereby rotating the drive shaft 14 in positive direction. The arm 6*a* is rotated downward resisting the bias force, and a paper feeding roller 7 makes a contact with the upper surface of the uppermost paper P piled up (stacked) in the paper feeding cassette 5. At this time, the paper feeding roller 7 is rotated in a feeding direction and a paper P is fed.

When the paper P is not separated from another paper P and is not fed from the paper feeding cassette 5, the LF motor 42 rotates in positive direction, and the drive shaft 14 rotates in reverse direction. Accordingly, the arm 6*a* is rotated in upward direction (direction in which the arm 6 is separating away from the lower surface of the paper feeding cassette 5). At this time, the paper feeding roller 7 also rotates in reverse direction via a gear mechanism provided to the arm 6*a*.

Next, the recording unit 10 will be explained. As shown in FIGS. 2 to 5, the recording unit 10 includes a carriage 13 which has the recording head 12; the platen 11 made of a synthetic resin, and in the form of a plate; a CR (carriage) motor 24 for reciprocating the carriage 13; a timing belt 25 connected to the CR motor 24; pulleys 25*a* and 25*b*; a guide plate 40; an ink receiving section 35; the maintenance section 36; the transporting mechanism 200 (see FIG. 7); and the engine frame 39 made of a metallic plate for supporting the above-mentioned parts of components.

In order to reciprocate the carriage 13 to which the recording head 12 is provided, a timing belt 25 extended in the scanning direction (Y axis direction) is arranged on the upper surface of a guide plate 41 which is long in one direction and is disposed on a downstream side in the paper feeding direction (see a direction shown by an arrow A in FIG. 1. The timing belt 25 is arranged in a ring form to be wound around the pulleys 25*a* and 25*b*. The CR (carriage) motor 24 which drives the timing belt 25 is fixed to the lower surface of the guide plate 41 (see FIG. 3). A linear encoder (encoder strip) 37 is disposed in the guide plate 41 such that the linear encoder 37 is extended along a longitudinal direction (main scanning direction) of the guide plate 41. The linear encoder 37 detects a position and a moving direction of the carriage 13 in the Y axis direction (main scanning direction). The linear encoder (encoder strip) 37 in the form of a band is disposed such that its testing surface (surface in which slits arranged at a fixed interval are formed in the Y axis direction) is along a vertical direction.

Further, the engine frame 39 is disposed at portion on the rear side of the case 2 of the apparatus body, and above the paper feeding cassette 5. The engine frame 39 is a supporting frame made of a metal, and includes a body section 39*a* having a box shape, and a pair of side plates 39*b* and 39*c*. On a side of the upper portion of the body section 39*a*, the pair of guide plates 40 and 41 is provided. The guide plates 40 and 41 are extended in a left and right direction (main scanning direction, Y axis direction) of the case 2 of the apparatus body, and slidably support the carriage 13. Furthermore, to the body section 39, the arm 6*a* of the feeding unit 6 is rotatably (pivotally) supported by the drive shaft 14, and the platen 11 in the form of a flat plate, which faces the lower surface of the recording head 12 and supports the paper P, is also provided to the body section 39.

Figure 4:
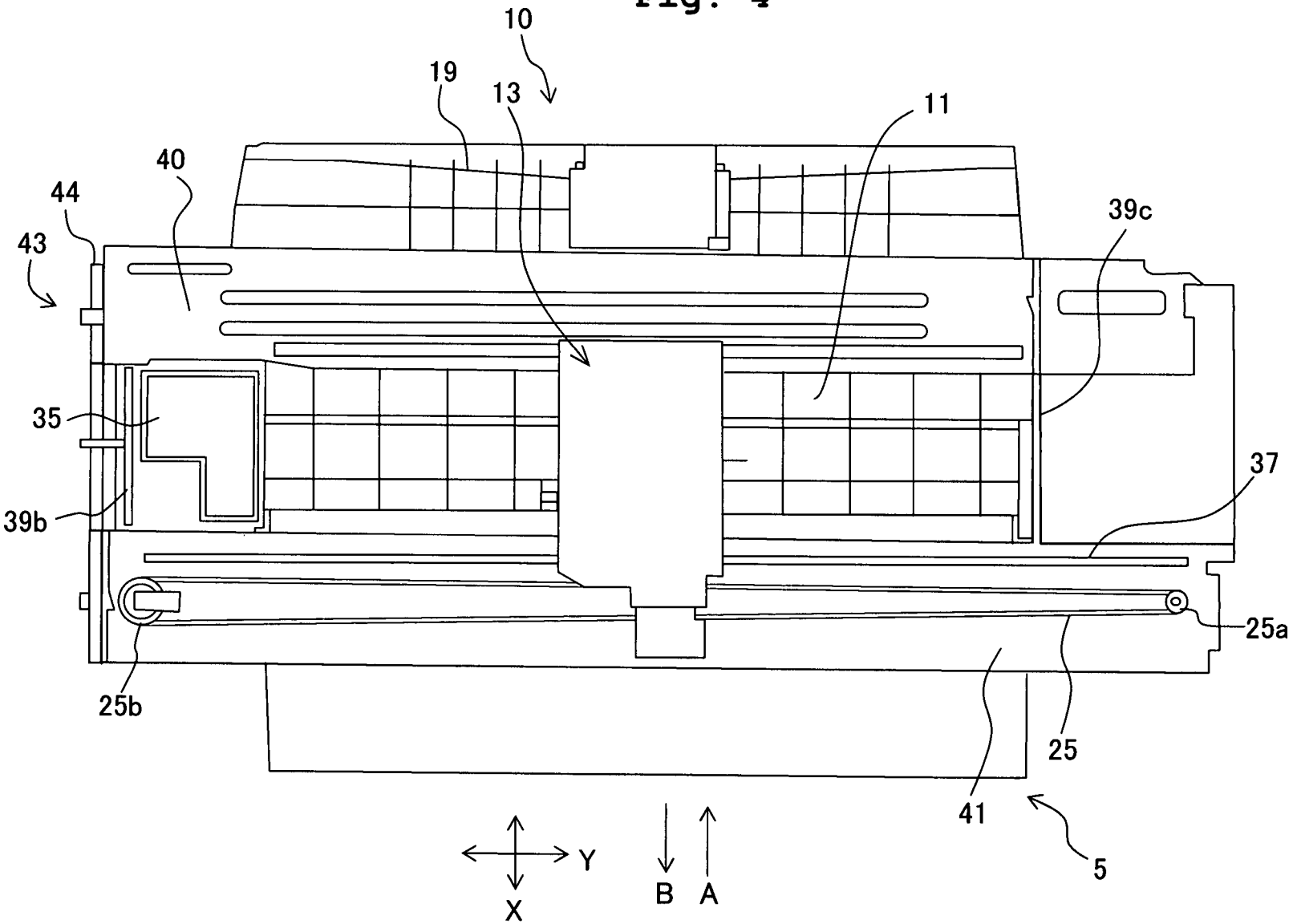
FIG. 4 is a plan view of a state in which a paper feeding cassette is attached to a recording unit.

Next, the ink receiving section 35 and the maintenance section 36 of the recording unit 10 will be explained. As shown in FIG. 4, the ink receiving section 35 is provided on a side of one end (toward side plate 39*b*; left side) of the recording unit 10, outside of the width of the paper P (short side of the paper P) which is transported; and the maintenance section (maintenance unit) 36 is provided on the other end side (toward side plate 39*c*; right side) of the recording unit 10. The recording head 12 periodically discharges ink for preventing the clog-up of a nozzle during a recording operation at a flashing position provided in the ink receiving section 35, and the discharged ink is received at the ink receiving section 35.

The maintenance section 36 includes a cap section 36*a*, a cleaner (wiper blade) 36*b*, and the motive-power transmission switching mechanism 100. In the maintenance section 36, a position at which the carriage 13 is at a right end in the main scanning direction (Y axis direction) is an origin position, and a position at which the carriage 13 is moved toward the left side from the origin position only by a predetermined distance along the Y axis direction is a maintenance position which also serves as a stand-by position. At the maintenance position which also serves as the stand-by position, the cap section 36*a* covers a nozzle surface of the recording head 12 from a lower side. As will be described later, by driving the LF motor 42 of the transporting mechanism 200, ink can be sucked selectively from the nozzles by activating a suction pump (not shown in the diagram), and a recovery process (treatment) or the like for removing air bubbles in a buffer tank (not shown in the diagram) on the recording head 12 can be performed. When the carriage 13 moves from the maintenance section 36 in a horizontal (lateral) direction to the image recording area, cleaning is performed by wiping the nozzle surface with the cleaner (wiper blade) 36*b*. The motive-power transmission switching mechanism 100 will be explained later in detail.

Next, the transporting mechanism 200 of the recording unit 10 will be explained. The transporting mechanism 200 includes a pair of resist rollers 20, a pressing mechanism (pushing mechanism) 160 (see FIG. 5) for the resist rollers, a pair of paper discharging rollers 21, the LF motor 42, and a gear mechanism 43. The pair of resist rollers (transporting rollers) 20 for feeding (sending) the paper P to the lower surface of the recording head 12 is arranged on an upstream side of the platen 11 in the transporting direction. The pair of paper discharging rollers 21 for transporting the paper P, onto which the recording has been performed, toward the paper discharging section 22 is arranged on a downstream side of the platen 11 in the transporting direction. The pair of resist rollers 20 includes a drive roller 20*a* and driven rollers 20*b* which are provided on portions above and below, respectively, with respect to the paper P which is transported. The driven rollers 20*b* are pressed against the drive roller 20*a* by the pressing mechanism 160 which will be described later in detail. Further, the pair of paper discharging rollers 21 includes a paper discharging roller 21*a* and spurs 21*b* which are provided in portions above and below, respectively, with respect to the paper P which is transported. Both end portions of each of the drive roller 20*a* and the paper discharging roller 21*a* are supported rotatably (pivotably) by an axis supporting (pivot supporting portion) provided to the pair of side plates39*b* and 39*c* of the engine frame 39. Here, the paper P is nipped (pinched, hold) between the drive roller 20*a* provided above the paper P and the driven roller 20*b* provided below the paper P. Further, in the pair of the paper discharging rollers 21, the paper discharging roller 21 makes a contact with the lower surface of the paper P, and the spurs 21*b* makes a contact with the upper surface of the paper P, thereby nipping the paper P.

Figure 6:
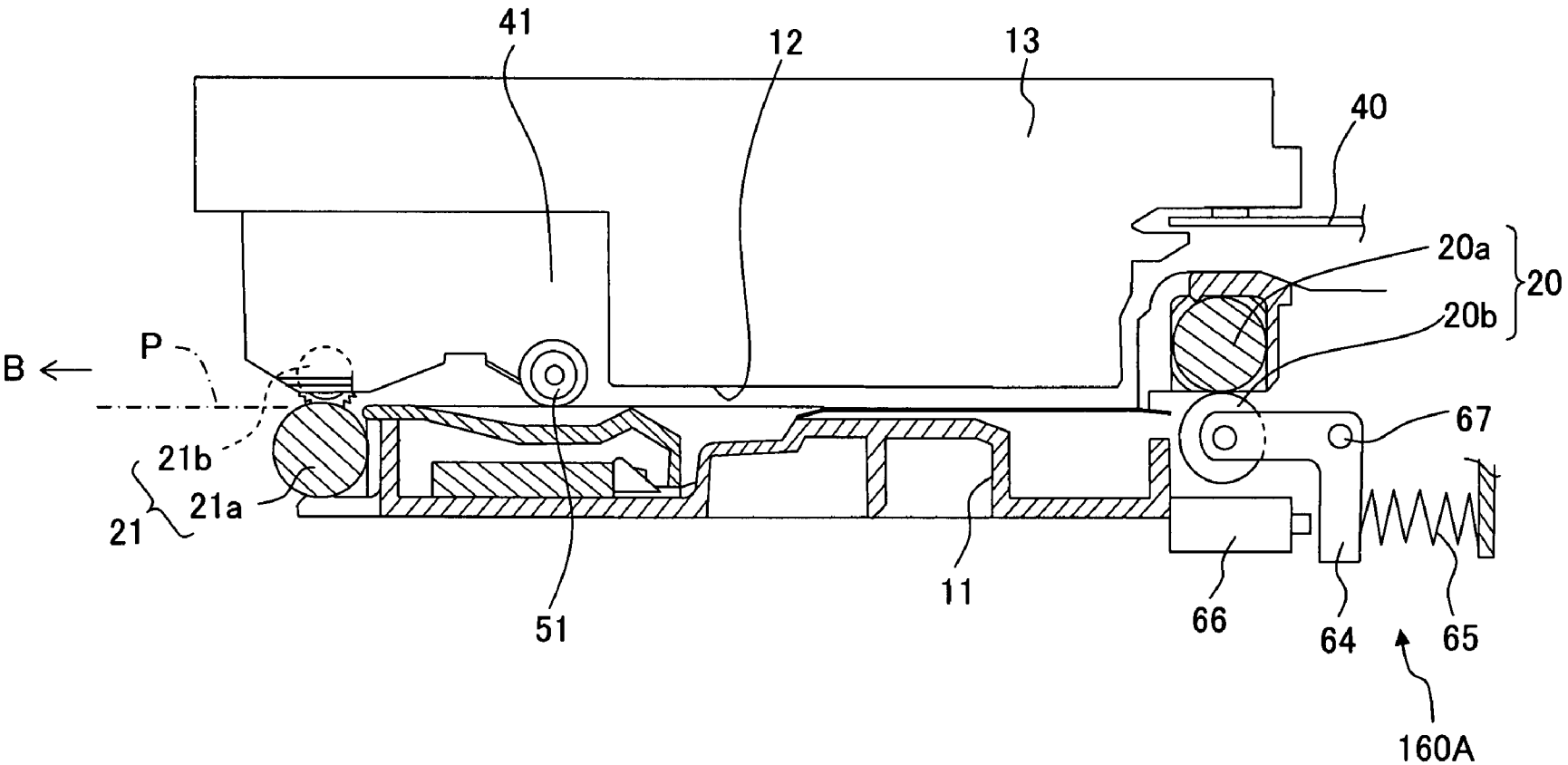
FIG. 6 is an enlarged cross-sectional view as viewed from a direction of an arrow, taken along a line VI-VI in FIG. 3.

A spur 51 is arranged at a position close to the upper surface of the platen 11 (see FIG. 6). Therefore, the paper P, after an image has been recorded thereon, is lifted (relieved) off and restrained from making a sliding (rubbing) contact with the nozzle surface of the recording head 12. Therefore, there is no fear that an image quality is degraded by being stained with the ink.

Figure 5:
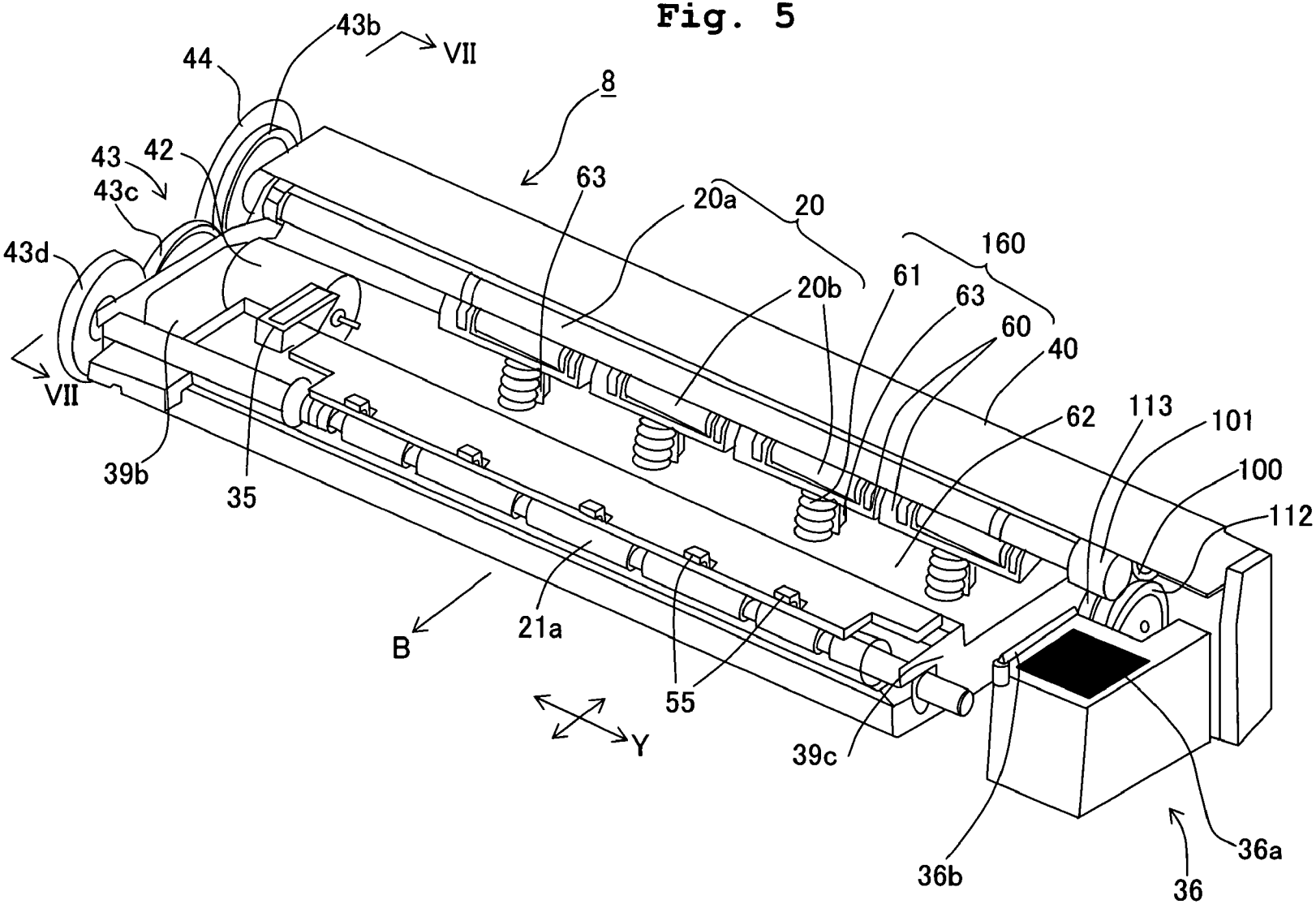
FIG. 5 is a perspective view of a recording unit in which a platen and a guide plate on a downstream side of a transportation direction are omitted.
Figure 7:
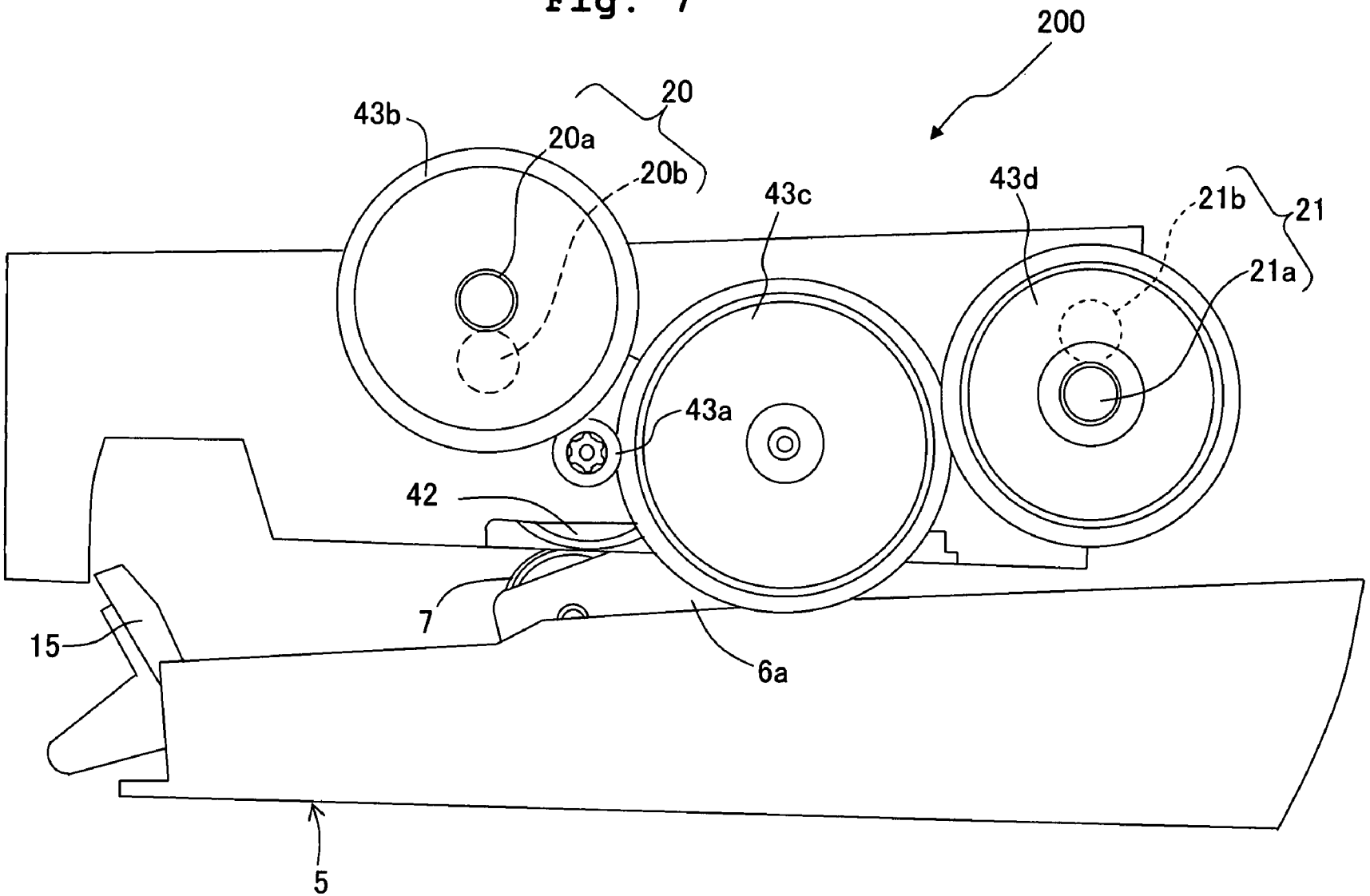
FIG. 7 is an enlarged cross-sectional view as viewed from a direction of an arrow, taken along a line VII-VII in FIG. 4.

A motive power from one common drive motor (LF motor) 42 which is arranged in the vicinity of the side plate 39*b* is transmitted to the drive roller 20*a* and the paper discharging roller 21*a*, via the gear mechanism 43 (see FIGS. 5 and 7). As shown in FIG. 7, the gear mechanism 43 includes a pinion 43*a* attached to a drive shaft of the LF motor 42 for transporting the paper; a power transmission gear 43*b* and an intermediate gear 43*c* which are engaged with the pinion 43*a* on left and right sides of the pinion 43*a* respectively; and a power transmission gear 43*d* which is engaged with the intermediate gear 43*c*. The power transmission gear 43*b* is attached to one side (left end portion) of the drive roller 20*a*. On the other hand, the power transmission gear 43*d* is attached to one end (left end portion) of the paper discharging roller 21*a*. In this case, by a rotational drive of the LF motor 42 in a predetermined direction, the drive roller 20*a* and the paper discharging roller 21*a* are rotated in mutually opposite directions. However, the drive roller 20*a* and the paper discharging roller 21*a* are arranged in a seperate manner on the upstream and downstream sides respectively, sandwiching a paper transporting path therebetween. Therefore, due to a combined (cooperated) action of the drive roller 20*a* and the paper discharging roller 21*a*, the paper P can be fed in a one direction.

A rotary encoder 44 for detecting a transporting amount of the paper P by the pair of transporting rollers 20 is attached to the gear mechanism 43.

In this embodiment, the LF motor 42, which is a DC motor, supplies the motive power not only to the drive roller 20*a* and the paper discharging roller 21*a*, but also to the maintenance section 36 and the feeding unit 6. The motive-power transmission switching mechanism 100 of the maintenance section 36 can selectively transmit the motive power to the feeding unit 6 and the maintenance section 36.

Figure 8:
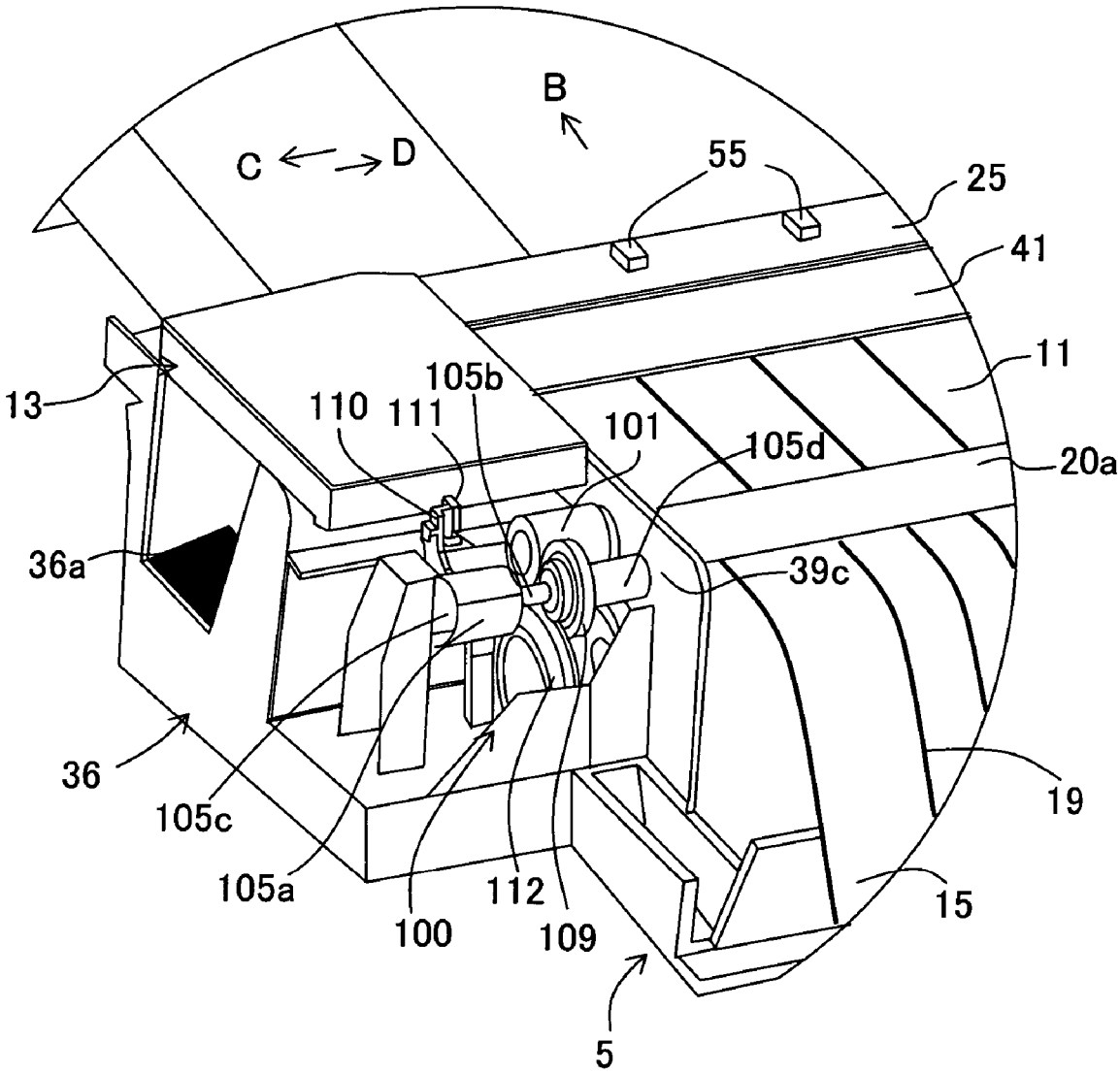
FIG. 8 is a perspective view of a carriage positioned at the maintenance section, as seen from an upstream side of the transporting direction.

Firstly, the structure of the motive-power transmission switching mechanism 100 which switches the motive-power transmission between the feeding unit 6 and the maintenance section 36 will be explained with reference to FIGS. 5 and 8. As shown in FIG. 8, the motive-power transmission switching mechanism 100 includes a drive gear 101, a shaft unit 105, a switching gear 109, a contact section 110, a maintenance-side gear 112, and a paper-feeding side gear. The drive gear 101 is provided to an end portion of the drive roller 20*a*, and is rotated integrally with the drive roller 20*a*. The shaft unit 105 includes a spindle 105*b* provided parallel to an axis (shaft line) of the drive roller 20*a*, a block section 105*a* slidably provided to the spindle 105*b*, a first bias-applying (force-imparting) spring 105*c* for applying bias on the block section 105*a* toward the side plate 39*c*, and a second bias-applying spring 105*d* which is arranged between the side plate 39*c* and the switching gear 109, for applying bias on the switching gear 109 toward the bock section 105*a*. Here, a bias applied by the second bias-applying spring 105*d* is set to be weaker than a bias applied by the first bias-applying spring 105*c*. The switching gear 109 is an intermediate gear which is always engaged with the drive gear 101. The switching gear 109 can be separated away (apart) from the block section 105*a*, and is slidably provided to the spindle 105*b*. The contact section 110 is formed integrally with the block section 105*a*, and is projected upward from the block section 105*a*. The maintenance-side gear 112 and the paper-feeding side gear 113 are arranged in a line(or side by side), both facing the switching gear 109.

Next, an operation of the motive-power transmission switching mechanism 100 will be explained. Firstly, as shown in FIGS. 5 and 7, and as described above, while torque (rotating force) from the LF motor 42 which is rotatable in positive and reverse directions is transmitted to the power transmission gear (speed-reduction gear) 43*b* from the pinion 43*a* of the gear mechanism 43, the torque is transmitted from the pinion 43*a* to the power transmission gear (speed-reduction gear) 43 via the intermediate gear 43*c*. Accordingly, the drive roller 20*a* of the pair of resist rollers 20, which is attached to the power transmission gear 43*b*, and the paper discharging roller 21*a* of the pair of paper discharging rollers 21, which is attached to the power transmission gear 43*d*, are rotated simultaneously.

When the motive power is transmitted to the maintenance section 36, the carriage 13 is moved in the left direction (direction indicated by an arrow C) in FIG. 8, to push the contact section 110 in the left direction in FIG. 8 with a pushing section 111 of the carriage 13, thereby separating the block 105*a* away from the switching gear 109 resisting (against) the bias applied by the first bias-applying spring 105*c*. Accordingly, the switching gear 109 is engaged with the maintenance-side gear 112, and thus the motive power is transmitted to the maintenance section 36 via a group (set) of gears not shown in the diagram. On the other hand, when the motive power is transmitted to the feeding unit 6, in FIG. 8, the carriage 13 is moved in the right direction (direction indicated by an arrow D) by a predetermined amount. At this time, due to the bias applied by the first bias-applying spring 105*c*, the block section 105*a* also comes closer to the side plate 39*c*, and thus the switching gear 109 is engaged with the paper-feeding side gear 113. Accordingly, the motive power is transmitted to the drive shaft 14 of the feeding unit 6 via a group (set) of gears not shown in the diagram. At this time, the arm 6*a* is descended (lowered) and the paper feeding roller 7 at a front end of the arm 6*a* is pressed (pushed) on the surface of the uppermost paper P of papers P piled (stacked) in the paper feeding cassette 5, and the paper feeding roller 7 is rotated and driven in the feeding direction.

Next, a structure for making the driven roller 20*b* in the pair of resist rollers 20 to be capable of approaching to and separating away from the drive roller 20*a* will be explained as follows. As shown in FIG. 5, the drive roller 20*a* is provided, at a fixed height, below the guide plate 40 on the upstream side of the engine frame 39. The driven roller 20*b* is provided as a plurality of driven rollers 20*b* such that the driven rollers 20*b* are capable of approaching to and separating away from the drive roller 20*a*, by the aid of the pressing mechanism (pushing mechanism) 160. This pressing mechanism 160 is in the form of a flat plate and is made of a synthetic resin, and includes roller holders 60 for supporting the plurality of driven rollers 20*b*, bias-applying springs 61 which apply bias to the driven rollers 20*b* respectively in the upward direction, a supporting plate 62 which is a flat plate and arranged below the bias-applying springs 61, and an actuator 63 such as an electromagnetic solenoid. In a normal condition, bias is applied to each of the driven rollers 20*b*, by one of the bias springs 61, to be pressed against the lower surface of the drive roller 20*a* which is long. Then, when the actuator 63 such as the electromagnetic solenoid (not shown in FIG. 5) is activated to be ON (see a functional block diagram in FIG. 9), all of the roller holders 60 are moved downwardly, and all of the driven rollers 20*b* are either separated away from the drive roller 20*a*, or the pressing force of the driven rollers 20*b* against the drive roller 20*a* is weakened. A structure may be adopted in which all of the driven rollers 20*b* are separated away from the drive roller 20*a* by constructing the supporting plate 62 in the form of a flat plate to be movable upwardly and downwardly, and by the support plate 62 is moved (descended) downwardly by the activation of the actuator 63 to be ON. In this case, the supporting plate 62 functions as a roller holder.

Modified Embodiment

In a modified embodiment shown in FIG. 6, a pressing mechanism 160A includes a L-shaped movable arm 64 which supports a plurality of driven rollers 20*b*, a rotating shaft 67 which is provided to the movable arm 64, a bias-applying spring 65, and an actuator 66 which is an electromagnetic solenoid. The driven rollers 20*b* are supported on a side of one end of the movable arm 64, and the movable arm 64 is rotatable (turnable) about the rotating shaft 67 as the center of rotation. On a side of the other end of the movable arm 64, the bias-applying spring 65 which applies bias to the driven rollers 20*b* and presses the driven roller 20*b* against the lower surface of the long drive roller 20*a* is provided. Due to the bias applied by the bias-applying spring 65, the movable arm 64 is rotated (turned) in a direction in which (in a direction such that) the driven rollers 20*b* makes a contact with the drive roller 20*a*. When the actuator 66 is activated to be ON, the actuator 66 pushes the movable arm 64 in a direction in which the bias-applying spring 65 is contracted. Accordingly, resisting the bias applied by the bias-applying spring 65, the driven rollers 20*b* are moved in a direction in which the bias-applying spring 65 is contracted, thereby separating the driven rollers 20*b* away from the drive roller 20*a*.

In the first embodiment and the modified embodiment, an actuator which is an electromagnetic solenoid is used. However, an actuator of other type such as a pneumatic actuator may also be used. Further, the number of driven and drive rollers may be arbitrary. Further, the shape of a movable arm in the modified embodiment may not be limited to L-shape, and may have arbitrary shape.

Next, a control section (control mechanism) of the image recording apparatus 1 will be explained with reference to FIG. 9. This control section is a section which controls an entire operation of the image recording apparatus.

This control section is structured as a microcomputer including a CPU (central processing unit) 300, a ROM (read only memory) 301, a RAM (random access memory) 302, and an EEPROM (electrically erasable and programmable read-only memory) 303 as its main components. The control section is connected to an ASIC (Application Specific Integrated Circuit) 306 via a bus 305.

Programs which control various operations of an ink-jet printer are stored in the ROM 301. Ram 302 is used as a working area and as a storage area for temporarily storing various data which is used when these programs are executed by the CPU 300.

An NCU (Network control unit) 317 is connected to the ASIC 306. A communication signal which is inputted from a public line via the NCU 317 is inputted to the ASIC 306 after being demodulated by a MODEM (modulator-demodulator) 318. On the other hand, when the ASIC 306 transmits out image data by a transmission such as a facsimile transmission, the image data is modulated to a communication signal by the MODEM 318, and this communication signal is outputted to the public line via the NCU 317.

Further, the ASIC 306 generates, in accordance with a command from the CPU 300, signals such as a phase excitation signal which are supplied (electrically distributes) to the LF motor 42, for example. The ASIC 306 applies these signals to a driving circuit 311 of the LF motor 42, and to a driving circuit 312 of the CR motor 24, and supplies driving signals to the LF motor 42 and the CR motor 24 via, for example, the driving circuit 311 and the driving circuit 312, respectively, and controls the rotation and stopping and the like of the LF motor 42 and the CR motor 24.

Further, a scanner unit 33 (such as a CIS (contact image sensor)) for reading an image and/or a character on a document (original), a panel interface 313 which includes a liquid crystal display (LCD) 30*b* and a keyboard 30*a* of the operation panel 30 for operation of transmitting and receiving, a USB interface 316 and a parallel interface 315 for transmitting and receiving data to and from an external device such as a personal computer, via a parallel cable or a USB cable are connected to the ASIC 306.

Furthermore, various sensors such as a leaf switch 103, a regi sensor 104, a rotary encoder 44, and a linear encoder 37 are connected to the ASIC 306. The leaf switch 103 is for detecting a rotating position of a cam (not shown in the diagram) of the maintenance section 36. The regi sensor 104 is provided in association with a detecting body (paper front-end edge detecting body) 106 which is disposed on a downstream side, in the transporting direction, of the U-turn transporting channel 9 so that the detecting body 106 detects a front end position of the paper P when the paper P is fed, via the U-turn transporting channel 9, to come close to the lower side of the recording head 2. The rotary encoder 44 is for detecting a rotation amount of the drive roller 20*a*. The linear encoder 37 is for detecting a moving position (current position) and a moving amount of the carriage 13 in the main scanning direction.

Figure 9:
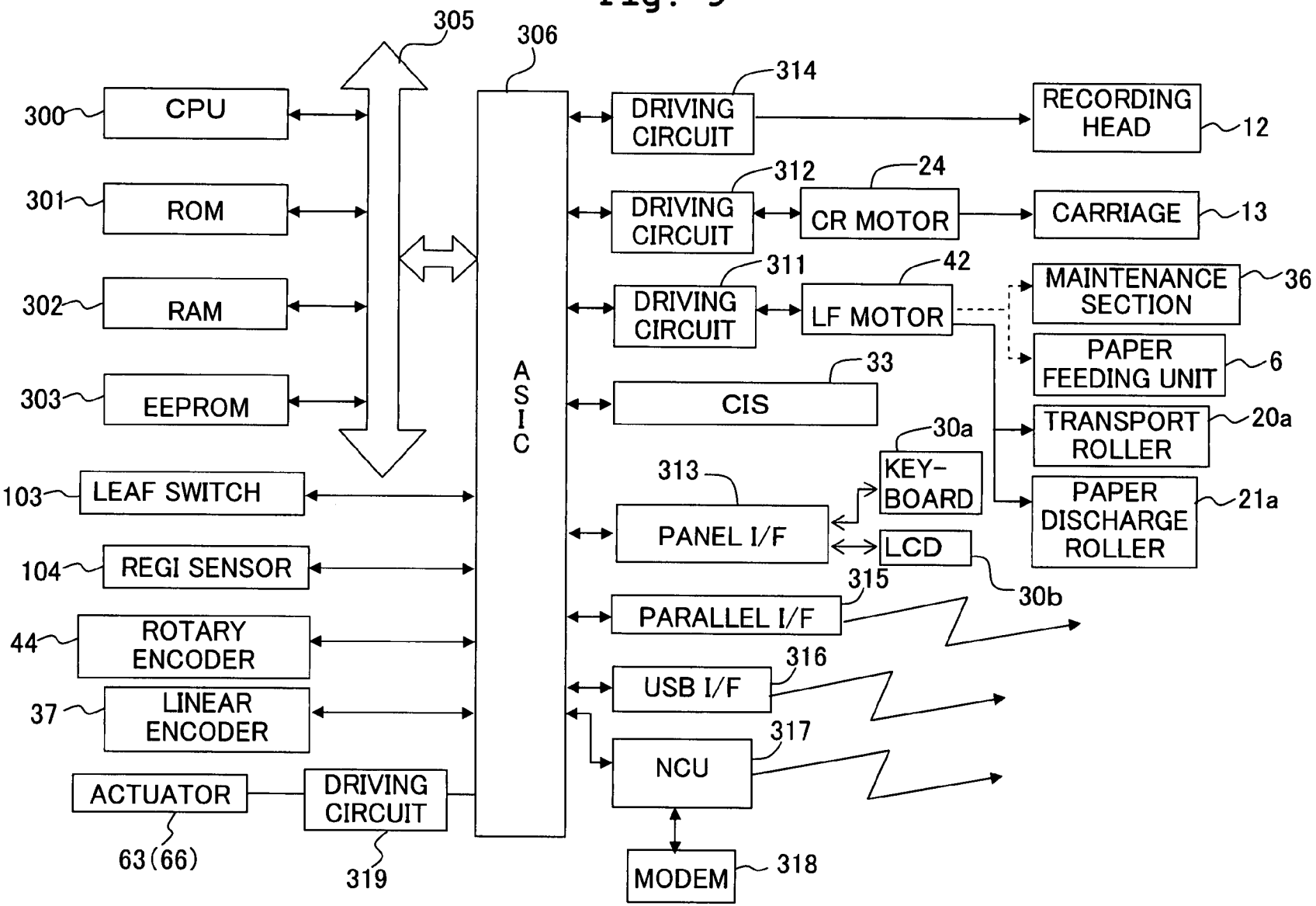
FIG. 9 is a functional block diagram of a control unit.

FIG. 9 also shows various driving circuits. Here, a driving circuit 314 is a circuit for discharging ink selectively onto the paper from the recording head 12, at a predetermined timing. The driving circuit 314 receives a signal which is generated in and outputted from the ASIC 306 based on a command of a drive-control procedure outputted from the CPU 300, and controls the driving of the recording head 12. A driving circuit 319 makes the actuator 63 (66) such as an electromagnetic solenoid to be activated ON and OFF, the actuator 63 (66) making the driven roller 20*b* to be separated away from the drive roller 20*a* in the pair of resist rollers 20 with respect to the drive roller 20*a*.

Figure 10:
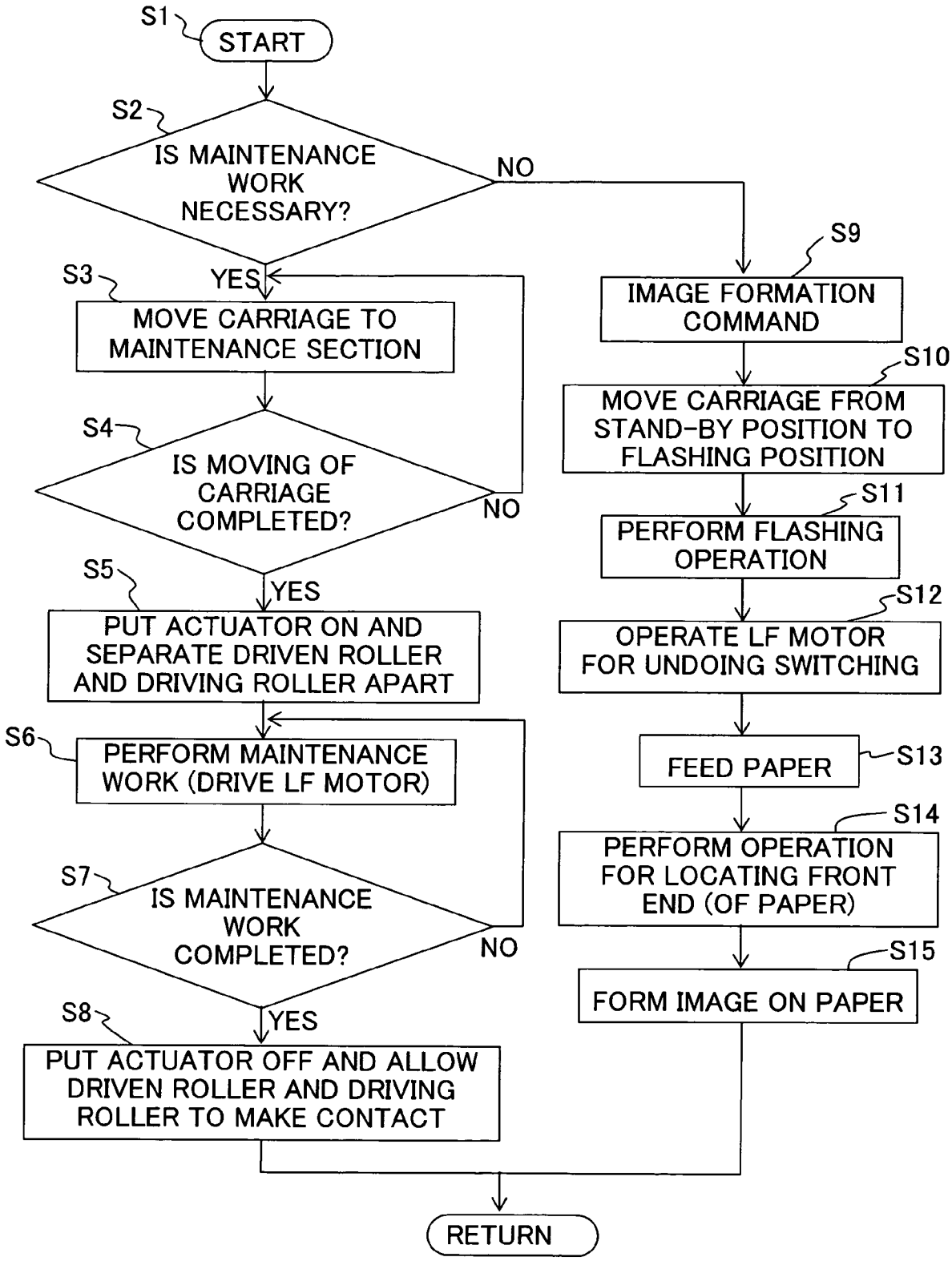
FIG. 10 is a flow chart of a control of image recording.

Next, a control of paper transporting and image recording by the control unit described above will be explained with reference to a flowchart shown in FIG. 10. In a state that electric power to the image recording apparatus 1 is not switched ON, the carriage 13 is stopped at a position on the upper surface of the maintenance section 36, and a nozzle portion of the recording head 12 in the carriage 13 is covered by being tightly contacted with the cap section 36*a* on the upper surface of the maintenance section 36 (this state is referred to as a stand-by state) (see FIG. 4).

When the power supply to the image recording apparatus 1 is switched ON, the control is started (step S1). Next, a judgment is made of whether or not a maintenance work is necessary when the image recording apparatus 1 is not used for a long period of time, and/or when it is necessary to replace an ink cartridge because an amount of ink remained in the cartridge becomes small during an image recording job (step S2). When the maintenance work is necessary ("yes" in step S2), if the carriage 13 is located at a position other than the position of the maintenance section 36, the CR motor 24 is driven, and as shown in FIG. 4, to make the carriage 13 stopped at the origin position or a maintenance position in the vicinity of the origin position (step S3 and step S4). The moving and stopping of the carriage 13 at a predetermined position can be detected by the linear encoder 37. When the carriage 13 is stopped at the maintenance position, then, the actuator 63 (66) is activated to be ON, and the driven rollers 20*b* are separated apart from the drive roller 20*a* (step S5). Further, for performing the maintenance work, the LF motor 42 is driven (step S6). In this state, although the drive roller 20*a* is rotated and driven, the driven rollers 20*b* are separated away from the drive roller 20*a*. Accordingly, a noise which would be otherwise generated when the driven rollers 20*b* are rotated in a state that the driven rollers 20 are pressed against the drive roller 20*a* is not generated, and it is possible to perform the maintenance work quietly, and also a rotational resistance which would be otherwise generated when the driven rollers 20*b* are rotated while being pressed against the drive roller 20*a* is vanished. Therefore, the LF motor 42 can be driven with small power consumption (energy consumption).

Further, when the carriage 13 is positioned at the maintenance section 36, as shown in FIG. 8, while the switching gear 109 and the maintenance-side gear 112 are engaged, the switching gear 109 and the paper-feeding side gear 113 are disengaged. By driving the LF motor 42 in this state, a suction pump which is not shown in the diagram is operated, and clog-up of the nozzle can be eliminated by sucking ink and/or air bubbles from the nozzle surface of the recording head 12.

When the maintenance work is completed ("yes" at step S7), the actuator 63 (66) is switched OFF, thereby making the driven rollers 20*b* to have a contact with and to press against the drive roller 20*a* (step S8).

When the maintenance work is not necessary ("no" in step S2), and then when there is an image recording command (step S9) from an external computer or the like which is not shown in the diagram, firstly, the LF motor 42 is rotated by only a predetermined number of step such that the cap section 36*a* is lowered (descended) with respect to the carriage 13 located at the above-mentioned stand-by position (origin position).

Next, the CR motor 24 is made to rotate in positive direction, and the carriage 13 is moved to a position above the ink receiving section 35 (flashing position) at the left end in FIG. 4 (step S10). Then, the ink is discharged to the ink receiving section 35 (step S11).

Instead of the control signal of the completion of the maintenance work described above, the control may be performed such that the actuator 63 (66) is switched OFF when the carriage 13 is separated away from the portion of the maintenance section 36 at step S10 mentioned above, and the driven rollers 20*b* are allowed to make contact with and press against the drive roller 20*a*.

At the time when the carriage 13 is separated away from the portion of the maintenance section 36, a small operation is performed for undoing switching. In this small operation, the positive rotation is repeated once or twice so that the LF motor 42 is returned to an original phase after once performing the reverse rotation, by an amount of phase less than one pitch of teeth of the gear. By performing this small operation, the engagement of the maintenance-side gear 112 and the switching gear 109 of the motive-power transmission switching mechanism 100 can be disengaged smoothly, and the switching gear 109 of the motive-power transmission switching mechanism 100 can be engaged smoothly with the paper-feeding side gear 113, by moving the switching gear 109 in a lateral direction (step S12).

Next, in a state that the switching gear 109 is engaged with the paper-feeding side gear 113, the motive power can be transmitted to the drive shaft 14 of the feeding unit 6. When the LF motor 42 is rotated in reverse direction for the paper feeding operation from the paper feeding cassette 5, the arm 6*a* is lowered, and the paper feeding roller 7 is rotated and driven in the feeding direction (step S13).

Figures 11A, 11B:
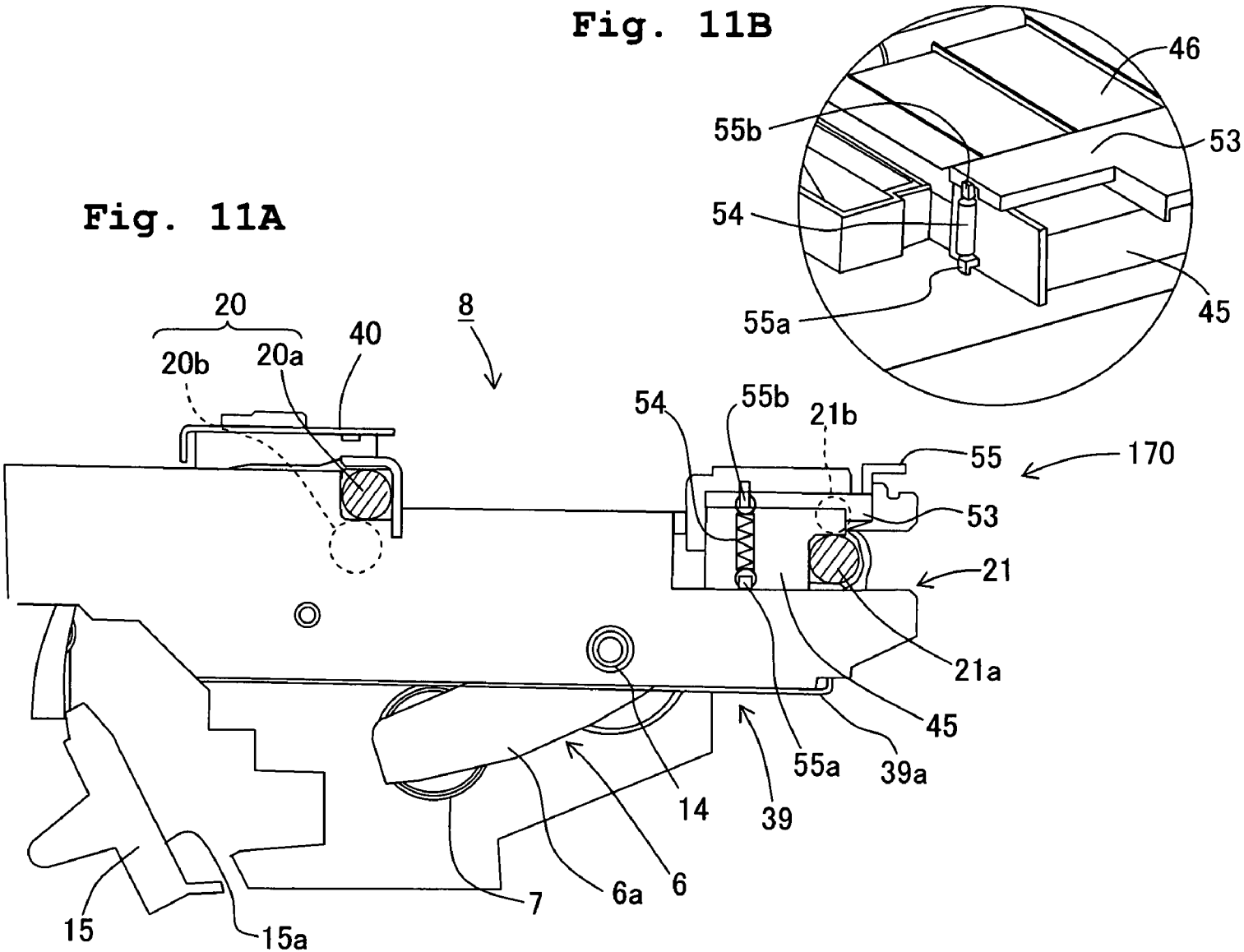
FIG. 11A is a partial side view showing a structure of the recording section unit inside a case 2 of the apparatus body.
FIG. 11B is a perspective view of an important portion showing a center of rotation and a bias application of a spur holder.

In this state, the transporting roller (drive roller) 20*a* in the pair of the resist rollers 20 is rotated in a clockwise direction in FIG. 11A. In this state, the pair of resist rollers 20 is rotated in reverse direction so that the paper P is not fed to a position below the recording head 12. Then, a paper P which is at the uppermost layer of the papers P stacked in the paper feeding cassette 5 is separated. The reverse rotation of the LF motor 42 is continued only for a predetermined number of step after the front-end edge of the separated paper P has passed the location of the paper front-end edge detecting body 106 positioned on the downstream side, in the transportation direction, of the U-turn transporting channel 9 shown in FIG. 2 (after being detected by the regi sensor 104), in other words, until the front-end edge of the paper P abuts against (makes contact with) the pair of resist rollers 20. Accordingly, the front-end edge of the paper P is matched (adjusted) such that the front-end edge is parallel to a roller shaft line (axis) of the pair of resist rollers 20. The paper discharging roller 21*a* in the pair of paper discharging rollers 21 is rotated in a counterclockwise direction in FIG. 2.

Next, the front end of the paper P is located by rotating the LF motor 42 in positive direction only by an appropriate number of steps (step S14). An operation of locating the front end of the paper P is an operation in which, after the front end of the paper P pinched by the pair of resist rollers 20 has passed the position at which the paper front-end edge detecting body 106 is located, the paper is allowed to advance up to a predetermined position below the recording head 12 and is set at a position where the image recording can be started. When the operation of locating the front end of the paper P is performed, the pair of resist rollers 20 and the pair of paper discharging rollers 21 rotates in positive direction. Further, the arm 6*a* is turned upward and the paper feeding roller 7 rotates in the reverse direction with respect to the feeding direction.

Next, while allowing the paper to advance intermittently and while reciprocating the carriage 13 in the main scanning direction, the ink is discharged from the nozzles of the recording head 12 onto one surface (front surface) of the paper P to perform the image recording (step S15). When the paper P is allowed to advance intermittently, the pair of resist rollers 20 and the pair of paper discharging rollers 21 are rotated in the same direction (positive rotation). Further, at the time of the operation of locating the front end of the paper P and the image recording, by rotating the drive shaft 14 in the reverse direction, the arm 6*a* is turned upward and the paper feeding roller 7 is rotated in the reverse direction (rotation in counterclockwise direction in FIG. 11A).

Second Embodiment

Figure 12A:
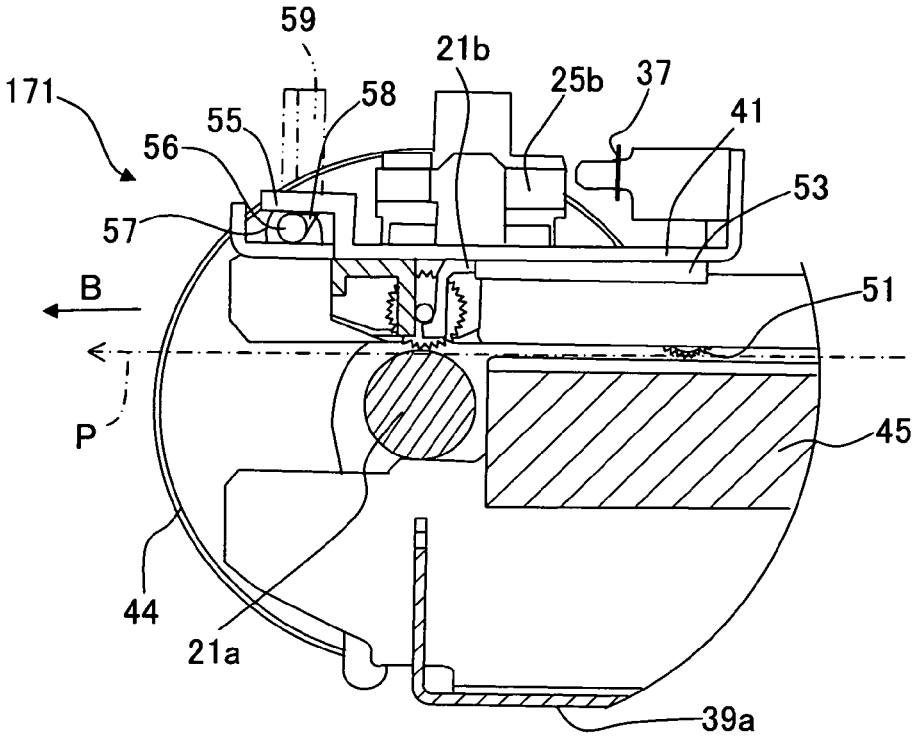
FIGS. 12A and 12B are diagrams explaining an action, shown by a cross-sectional view when viewed from a direction of arrows E and B, respectively, taken along a line XXII-XXII in FIG. 4.
Figure 12B:
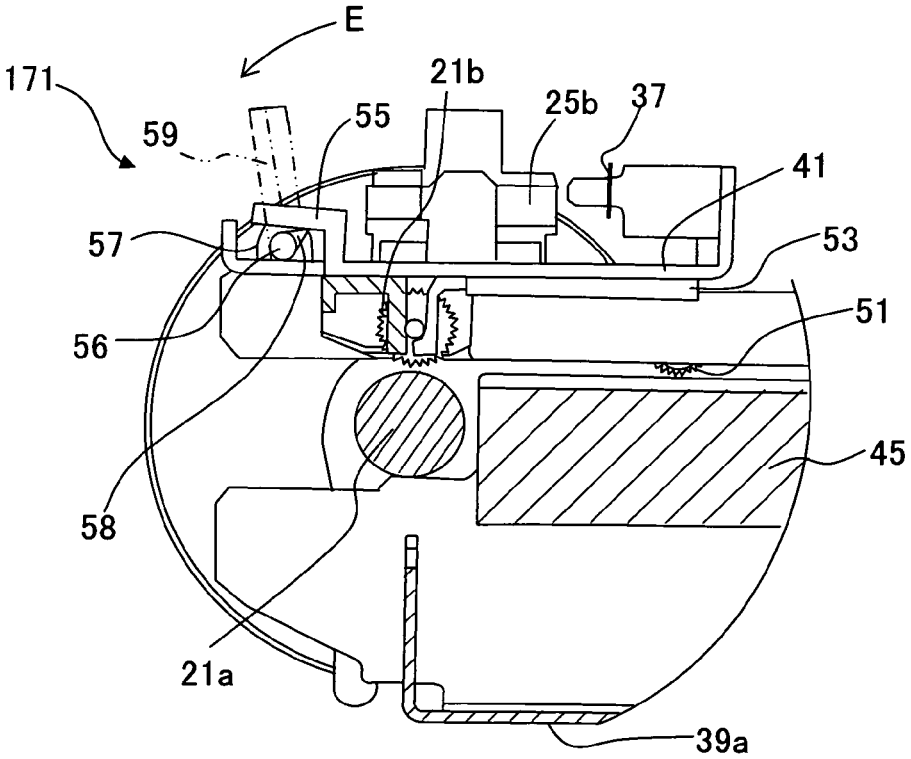

Next, the second embodiment will be described. In the second embodiment, the spur 21*b* in the pair of paper discharging rollers 21 is structured such that the spur 21*b* is capable of approaching close to and separating away from the paper discharging roller 21*a*. The structure of the second embodiment is similar to that of the first embodiment except that the transporting mechanism 200 of the recording unit 10 in the second embodiment includes a pressing (pushing) mechanism 170 for the spur. The pressing mechanism 170 of the spur includes a spur holder 53, a coil spring 54, and a cam mechanism 171. As shown in FIGS. 12A and 12B, the paper discharging roller (drive roller) 21*a* is provided at a fixed height in the body section 39*a* of the engine frame 39. The spur holder 53 is arranged close to the lower surface of the guide plate 41 above the paper discharging roller 21*a*, and to be movable upwardly and downwardly. The spur 21*b* is provided as a plurality of spurs 21*b* and arranged, in the spur holder 53, at suitable intervals along a line of axis of rotation of the drive roller 21*a*. The spur holder 53 is in the form of a flat plate made of a synthetic resin. Further, hooks 55*a* are provided on both end portions, respectively, in a longitudinal direction (Y axis direction) of the spur holder 53, and a hook 55*b* is provided on a side end of a main supporting member 45 fixed to the body section 39*a*. Between the hook 55*a* and the hook 55*b*, the coil spring 54 is mounted (or hooked). It is constructed such that the coil spring 54 applies bias in downward direction to the spur holder 53 such that, the lower end portion of a spur portion on a periphery of each of the spurs 21*b* comes closer to or makes a contact with the upper surface of the paper discharging roller 21*a* (see FIGS. 11A and 11B).

In one end portion on the downstream side in the transporting direction, of an upper surface of the spur holder 53, contact bodies 55 having a shape of an alphabet "L" are provided integrally at appropriate intervals along the Y axis direction. These contact bodies 55 are arranged such that the contact bodies 55 face the upper surface of the guide plate 41 on the downstream side (see FIGS. 11A, 12A, 12B, 13, and 14). The cam mechanism 171 (separation activating mechanism) is provided between the spur holder 53 and the guide plate 41 which guides and supports the carriage 13. The cam mechanism 171 has a function of moving the spur holder 53 in a direction such that the spurs 21*b* are separated away from the paper discharging roller 21*a*.

The cam mechanism 171 includes a bearing section 57, an operating shaft 56, a pushing-up operating section (cam section) 58, and a contact lever 59 (see FIGS. 12A, 12B, 13, and 14). The bearing section 57 is provided, along the Y axis direction, to the end portion on the downstream side in the transporting direction of the upper surface of the guide plate 41. The operating shaft 56 is rotatably supported by the bearing section 57. The pushing-up operating section (cam section) 58 is a drop-shaped section formed integrally with the operating shaft 56. The contact lever 59 is erected upward at a portion of the operating shaft 56 in the vicinity of the maintenance section 36. The contact lever 59 has a shape of an isosceles triangle, in a plan view, projecting on the upstream side in the transporting direction, and the contact lever 59 tilts the cam section by making a contact with a contact section (portion) of the carriage 13 positioned at the maintenance section 36.

Next, an operation of the cam mechanism 17 will be explained. For making the spurs 21*b* to be separated away from the paper discharging roller 21*a*, firstly, the carriage 13 is moved along the main scanning direction (Y axis direction), and is positioned in the maintenance section 36. At this time, a rear end surface (rear contact portion) 13*a* of the carriage 13 (see FIGS. 13 and 14) pushes the contact lever 59 and rotates the operating shaft 56 in the counterclockwise direction in FIG. 12B (direction indicated by an arrow E in FIG. 12B). Accordingly, when the pushing-up operating section 58 pushes the contact body 55 up, the spur holder 53 rotates upwardly and in the clockwise direction in FIG. 12B, resisting the bias applied by the coil spring 54, and all of the spurs 21*b* are separated away from the upper surface of the paper discharging roller 21*a* (see the state shown in FIG. 12B). For making the spurs 21*b* to have a contact with the paper discharging roller 21*a*, the carriage 13 is moved from the maintenance section 36 in a direction in which the carriage 13 goes out to the image recording area (direction indicated by an arrow D in FIG. 8). At this time, the rear end surface (rear contact portion) 13*a* of the carriage 13 is separated from the contact lever 59, the spur holder 53 is rotated in the downward direction, and the spurs 21*b* make a contact with the upper surface of the paper discharging roller 21*a*.

Figure 16:
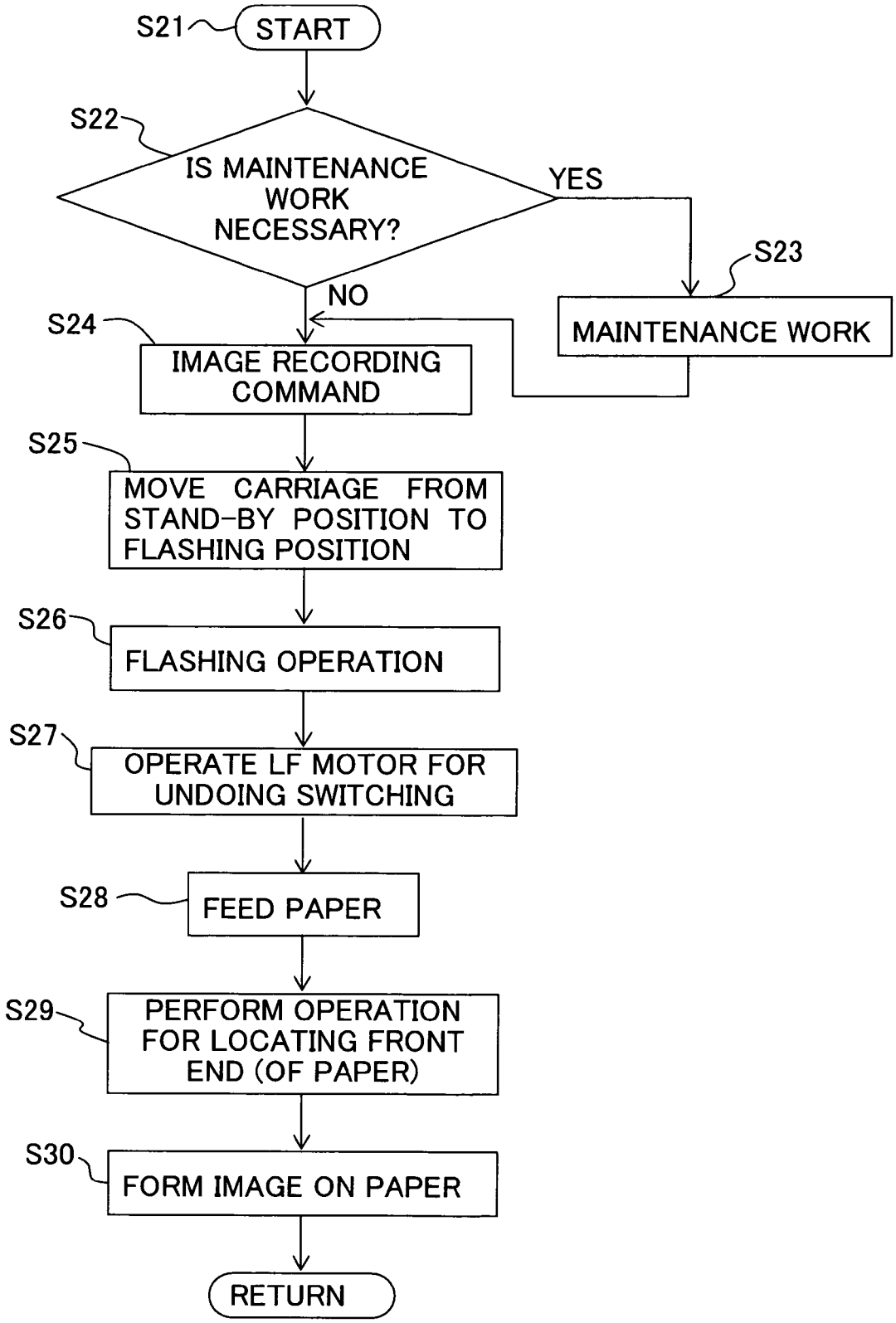
FIG. 16 is a flow chart of the control of the image recording.

Next, control of the transporting of paper and the image recording by the control mechanism will be explained below with reference to a flow chart shown in FIG. 16. In a state that the power supply to the image recording apparatus 1 is not switched ON, the carriage 13 is stopped at a position on the upper surface of the maintenance section 36, and the nozzle portion of the recording head 12 in the carriage 13 have a contact with the cap section 36 to be tightly covered by the cap section 36*a*, the cap section 36 being on the upper surface of the maintenance section 36 (this state is referred to as a stand-by state) (see FIGS. 4, 13, and 8).

Figure 13:
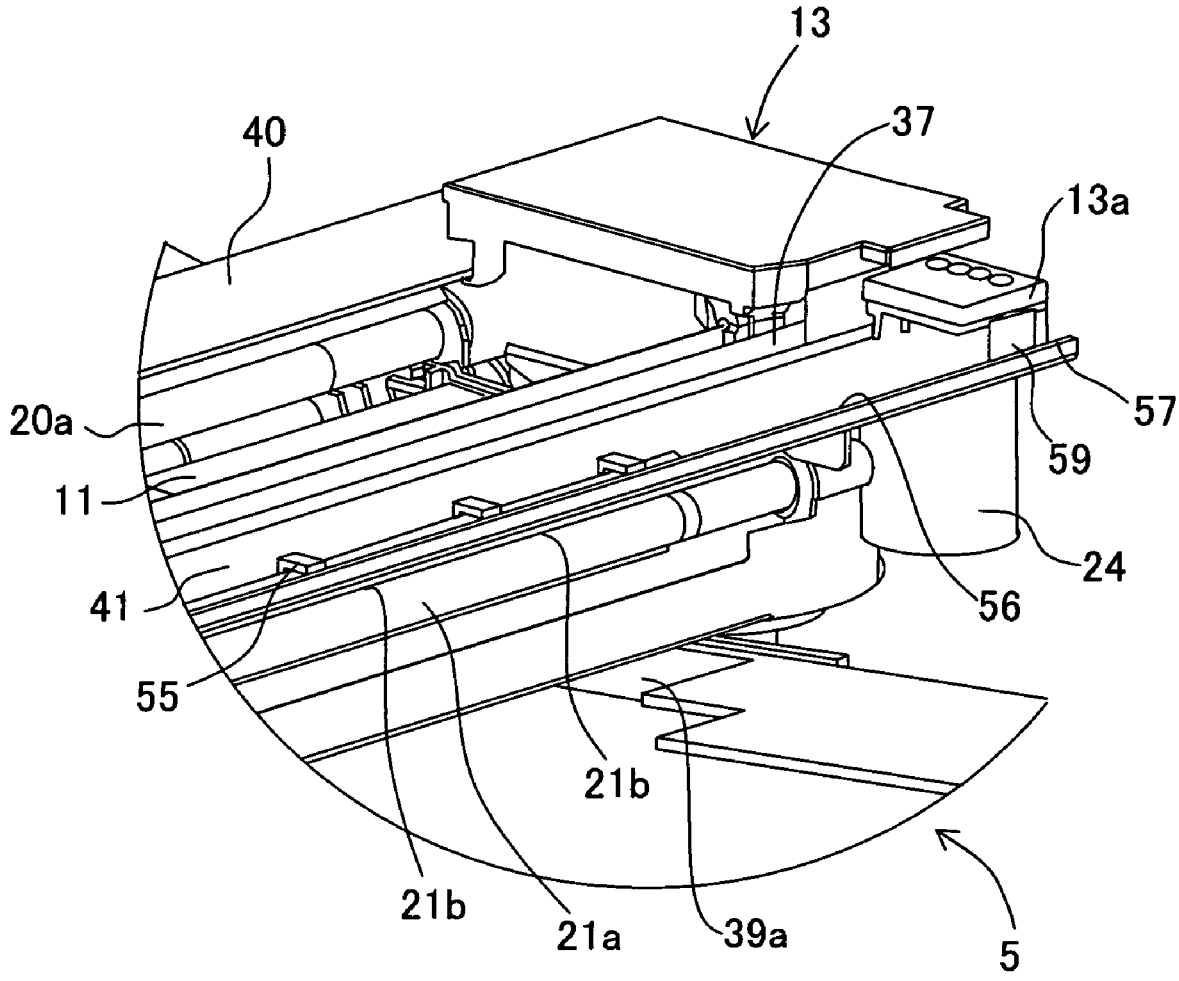
FIG. 13 is a perspective view of a state in which the carriage is positioned at the maintenance section (when the spur holder is moved upward) as viewed from a side of a pair of paper discharging rollers.

When the power supply to the image recording apparatus 1 is switched ON, the control is started (step S21). Next, a judgment is made whether or not a maintenance work is necessary, for example, when the image recording apparatus 1 has not been used for a long period of time, and/or when it is necessary to replace an ink cartridge (step S22). When the maintenance work is necessary ("yes" at step S22), the following maintenance work is performed (step S22). Namely, the CR motor 42 is driven, and as shown in FIG. 4, the carriage 13 is stopped at the origin position or the maintenance position which is in the vicinity of the origin position. At this time, as shown in FIGS. 4 and 13, the contact lever 59 is in a state that the contact lever 59 is pushed in the direction of the arrow E in FIG. 12B, at the rear end surface 13*a* of the carriage 13, and the operating shaft 56 is made to rotate in the counterclockwise direction in FIG. 12B. Accordingly, the pushing-up operating section 58 pushes the contact body 55 up, the spur holder 53 is rotated upwardly in the clockwise direction in FIG. 12B, resisting the bias applied by the coil spring 54, and all of the spurs 21 are separated away from the upper surface of the paper discharging roller 21*a*.

Further, when the carriage 13 is positioned at the maintenance section 36, as shown in FIG. 8, while the switching gear 109 and the maintenance-side gear 112 are engaged, the switching gear 109 and the paper-feeding side gear 113 are disengaged. By driving the LF motor 42 in this state, the suction pump which is not shown in the diagram is operated, and it is possible to eliminate the clog-up of the nozzle by sucking ink and/or air bubbles from the nozzle surface of the recording head 12. In this state, as mentioned above, all of the spurs 21*b* are separated away from the upper surface of the paper discharging roller 21*a*. Accordingly, even when the paper discharging roller 21*a* is rotated and driven by driving the LF motor 42, the spurs 21*b* are not rotated accompanied by the rotation of the paper discharging roller 21*a*. Therefore, it is possible to eliminate a situation which is associated in the conventional apparatus and in which front ends of the spurs 21*b* are rotated accompanied by the rotation of the paper discharging roller 21*a*, with the spurs 21*b* making a contact with the paper discharging roller 21*a* thereby generating a loud noise. Thus, the maintenance work can be performed quietly.

When the maintenance work is not necessary ("no" at step S22), and then when there is an image recording command from an external computer (not shown in the diagram) or the like (step S24), firstly, the LF motor 42 is rotated only by a predetermined number of step such that the cap section 36*a* is lowered with respect to the carriage 13 located at the above-mentioned stand-by position (origin position).

Next, the CR motor 24 is rotated in the positive direction and the carriage 13 is moved to a position above the ink receiving section 35 (flashing position) at the left end in FIG. 4 (step S25). Then, the ink is discharged to the ink receiving section 35 (step S26).

Figure 14:
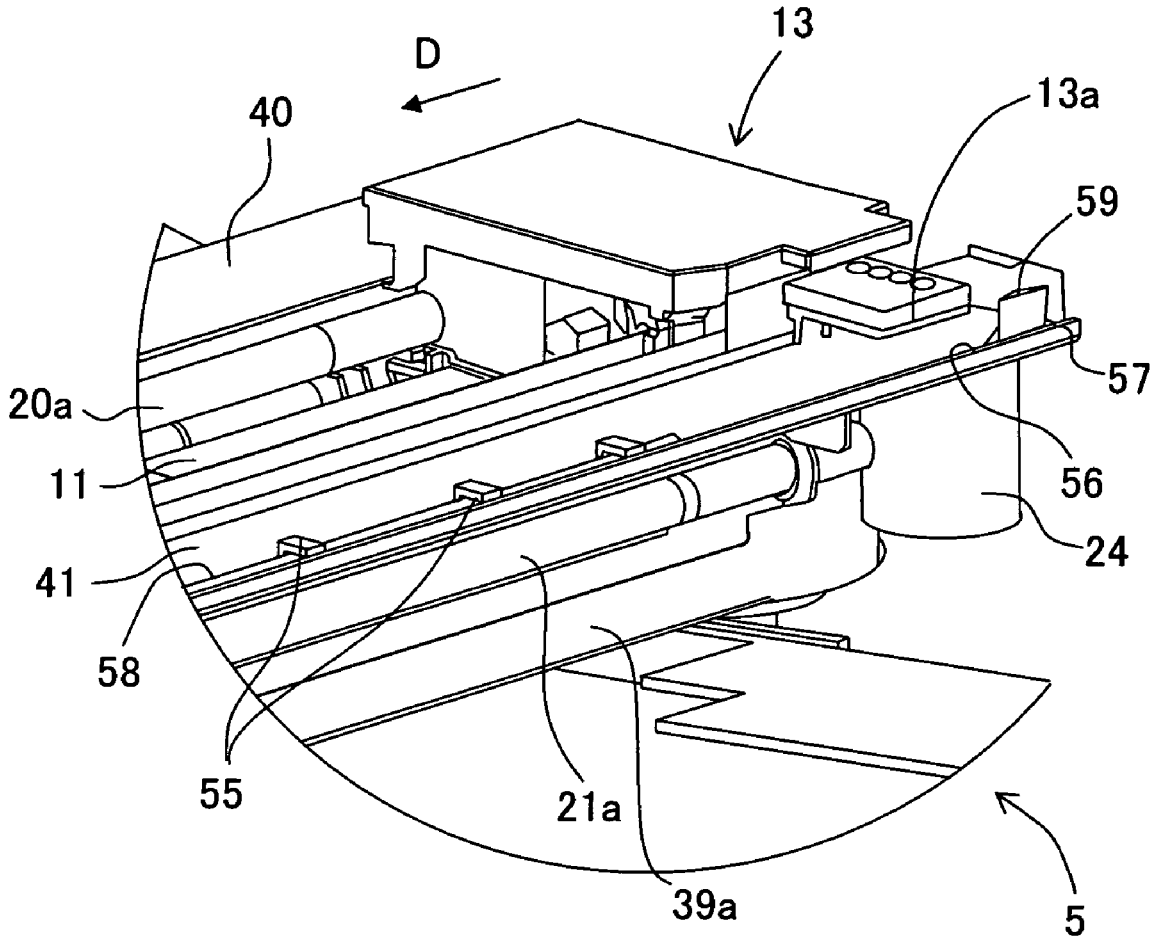
FIG. 14 is a perspective view of a state in which a spur holder is rotated downward by the carriage which is movable in a direction toward an image recording area, as viewed from the side of the pair of paper discharging rollers.
Figure 15:
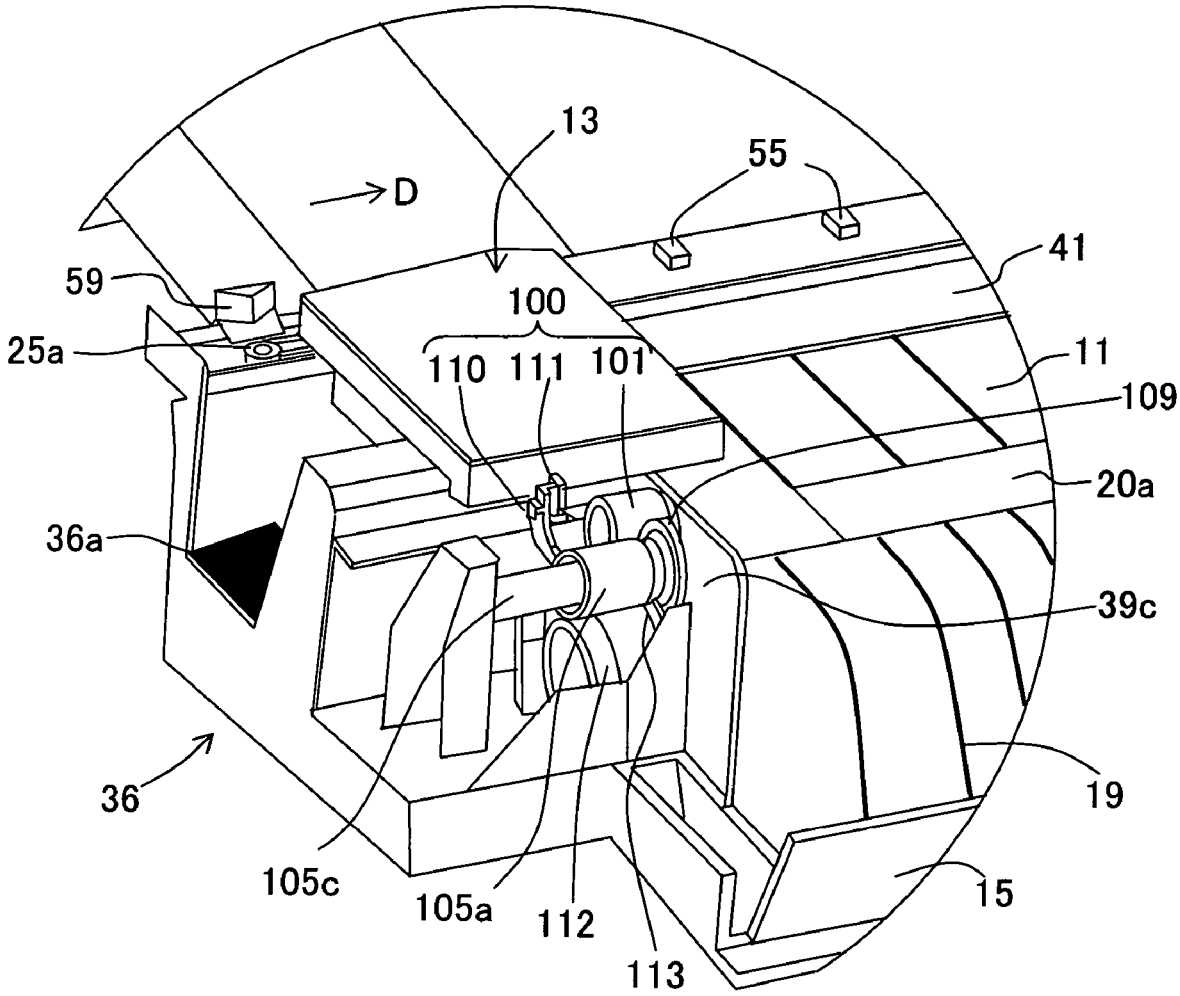
FIG. 15 is a perspective view, as viewed similarly from the upstream side in the transporting direction.

When, in step S25, the carriage 13 is separated apart from the portion of the maintenance section 36 (when the carriage 13 is moved in the direction of the arrow D in FIGS. 14 and 15), the rear end surface 13*a* is separated away from the contact lever 59 (see FIGS. 14 and 15). Then, as shown in FIG. 12A, the pushing-up operating section 58 attached to the operating shaft 56 is rotated in the clockwise direction such that the pushing-up operating section 58 is separated away from the lower surface of the contact body 55, and the spur holder 53 is moved downwardly due to the bias applied by the coil spring (bias applying unit) 54 shown in FIG. 11. Therefore, all of the spurs 21*b* make a contact with the upper surface of the paper discharging roller 21*a* which can be driven. On the other hand, at the time when the carriage 13 is separated away from the portion of the maintenance section 36, a small operation is performed for undoing switching. In this small operation, the positive rotation is repeated once or twice so that the LF motor 42 is returned to an original phase after once performing the reverse rotation, by an amount of phase less than one pitch of teeth of the gear. By performing this operation, the engagement of the maintenance-side gear 112 and the switching gear 109 of the motive-power transmission switching mechanism 100 can be disengaged smoothly, and the switching gear 109 and the paper-feeding side gear 113 can be engaged smoothly by moving the motive-power transmission switching mechanism in the lateral direction (step S27).

Next, as shown in FIG. 15, in a state that the switching gear 109 is engaged with the paper-feeding side gear 113, the motive power of the feeding unit 6 can be transmitted to the drive shaft 14. For the paper feeding operation from the paper feeding cassette 5, when the LF motor 42 is rotated in the reverse direction, the arm 6*a* is lowered, and the paper feeding roller 7 is rotated and driven in the paper feeding direction (counterclockwise direction in FIG. 2) (step S28). Accordingly, a paper P which is at the uppermost layer of the papers P piled in the paper feeding cassette 5 is separated, and is fed to the U-turn transporting channel 9.

However, when the LF motor 42 is rotated in the reverse direction, the transporting roller (drive roller) 20*a* in the pair of the resist rollers 20 is rotated in the clockwise direction. In other words, the pair of the resist rollers 20 rotates in a state that the paper P is not transported (fed) to the position below the recording head 12 (reverse rotation state). The state in which the LF motor 42 rotates in the reverse direction is further continued only for a predetermined number of steps after the front-end edge of the separated paper P has passed the location of the paper front-end edge detecting body 106 positioned at the downstream side, in the transportation direction, of the U-turn transporting channel 9 shown in FIG. 2 (after being detected by the regi (resi) sensor 104), in other words, until the front-end edge of the paper P abuts against (makes contact with) the pair of resist rollers 20. Accordingly, the front-end edge of the paper P is matched such that the front-end edge is parallel to the roller shaft line (axis) of the pair of resist rollers 20. At this time, the paper discharging roller 21*a* in the pair of paper discharging rollers 21 is rotated in the clockwise direction in FIG. 2.

Next, while making the paper P to advance intermittently by rotating the LF motor 42 in the positive direction, and while reciprocating the carriage 13 in the main scanning direction, ink is discharged from the nozzles of the recording head 12 onto one surface (front surface) of the paper P so as to perform the image recording (step S30). When the paper P is made to advance intermittently, the pair of resist rollers 20 and the pair of paper discharging rollers 21 are rotated in the same direction (positive direction). On the other hand, at the time of the operation of locating the front end of the paper P and the image recording, by rotating the drive shaft 14 in the reverse direction, the arm 6*a* is turned upward and the paper feeding roller 7 is rotated in the reverse direction (counterclockwise rotation in FIG. 11A).

The present invention is not limited to the embodiments described above and with reference to the drawings, and various modifications can be made within a scope of the gist of the present invention. For example, in the embodiments mentioned above, a DC motor is used as a CR motor and an LF motor. However, other motor such as a stepping motor may be used. Further, only one of the mechanism for separating the pair of resist rollers described in the first embodiment, and the mechanism for separating the pair of the paper discharging rollers described in the second embodiment may be used in the image recording apparatus, or both of the mechanisms may be used in the image recording apparatus. Furthermore, in the embodiments and the modified embodiment described above, among rollers constructing the pair of rollers, a roller which is not driven by the motor is moved in a direction such that the roller in the pair not driven by the motor is separated from other roller of the pair. However, in addition to this, or instead of this, a roller which is driven by the motor may be moved in a direction such that the roller in the pair driven by the motor is separated from other roller which is not driven by the motor. Moreover, in the embodiments and the modified embodiment described above, the description is made by giving an example of the image recording apparatus which is provided with the pair of paper discharging rollers including the paper discharging roller and the spur, and the pair of resist rollers including the drive roller and the driven roller. However, in addition to this, or instead of this, the image recording apparatus may be provided with another pair of rollers which include other rollers. Further, the image recording apparatus can be provided with a mechanism which adjusts a pressing force of the another pair of rollers. Another pair of rollers can be exemplified by a pair of rollers for transporting the paper in the reverse direction upon performing a double face (two-side) printing, but not limited to such pair of rollers, and the present invention is applicable to arbitrary pair of rollers of the image recording apparatus.

What is claimed is:

1. An image recording apparatus which records an image on a recording medium, the image recording apparatus comprising:

an image recording section having a recording head, and a carriage to which the recording head is provided and which is movable in a predetermined direction;

a maintenance section which performs a maintenance of the recording head; a first roller which is driven, and a second roller which is arranged facing the first roller and which transports the recording medium by nipping the recording medium between the first roller and the second roller;

an adjustment mechanism which adjusts a pressing force exerted by the second roller on the first roller; and a motor which commonly drives the first roller and the maintenance section; wherein when the motor drives the maintenance section, the adjustment mechanism reduces the pressing force of the second roller exerted on the first roller.

2. The image recording apparatus according to claim 1, further comprising:

a feeding roller which is driven by the motor and which feeds the recording medium by separating the recording medium from another recording medium; and a motive-power transmission-switching mechanism which transmits a motive power of the motor by switching the motive power to one of the feeding roller and the maintenance section.

3. An image recording apparatus which records an image on a recording medium, the image recording apparatus comprising:

a supplying section which supplies the recording medium;

an image recording section having a recording head, and a carriage to which the recording head is provided and which is movable in a predetermined direction;

a maintenance section which performs a maintenance of the recording head; and a transporting mechanism which transports the recording medium transported from the supplying section to the image recording section, the transporting mechanism including:

a pair of resist rollers including a drive roller and a driven roller;

a bias-applying unit which presses the driven roller against the drive roller;

a common drive motor which drives the drive roller and the maintenance section; and an actuator which separates the driven roller away from the drive roller, or which weakens a pressing force of the driven roller against the drive roller;

wherein when the carriage is positioned at the maintenance section, and when the maintenance section is performing the maintenance of the recording head, the actuator is driven to separate the driven roller away from the drive roller, or to weaken the pressing force of the driven roller against the drive roller.

4. The image recording apparatus according to claim 3, further comprising a roller holder which holds the driven roller, wherein the actuator moves the roller holder to separate the driven roller away from the drive roller, or to weaken the pressing force of the driven roller against the drive roller.

5. The image recording apparatus according to claim 4, further comprising a control unit which controls the actuator.

6. The image recording apparatus according to claim 3, wherein the actuator is inactive when the carriage is moved from the maintenance section to an image recording area at which the image recording section performs a recording of the image.

7. The image recording apparatus according to claim 3, wherein:

a pair of paper discharging rollers including a paper discharging roller and a spur is arranged on a downstream side of the carriage in a transporting direction of the recording medium; and the drive roller of the pair of resist rollers and the paper discharging roller of the pair of paper discharging rollers are rotated and driven in a same direction by the common drive motor.

8. The image recording apparatus according to claim 3, further comprising:

a feeding roller which is driven by the common drive motor and which feeds the recording medium by separating the recording medium from another recording medium; and a motive-power transmission-switching mechanism which transmits a motive power of the common drive motor by switching the motive power to one of the feeding roller and the maintenance section.

9. An image recording apparatus which records an image on a recording medium, the image recording apparatus comprising:

an image recording section having a recording head, and a carriage to which the recording head is provided and which is movable in a direction intersecting a transportation direction in which the recording medium is transported;

a maintenance section which performs a maintenance of the recording head; and a paper discharging mechanism which is arranged on an downstream side of the carriage in the transporting direction of the recording medium and which holds the recording medium and transports the recording medium in the transporting direction, the paper discharging mechanism including:

a paper discharging roller which is driven;

a spur which is arranged to face the paper discharging roller and which is capable of making a contact with the paper discharging roller;

a spur holder which supports the spur and which is provided to be movable away from and closer to the paper discharging roller; and a moving unit which moves the spur holder in a direction such that the spur is separated away from the paper discharging roller, when the carriage is positioned at the maintenance section.

10. The image recording apparatus according to claim 9, wherein the moving unit is a cam mechanism which is interposed between the spur holder and a supporting frame which guides and supports the carriage.

11. The image recording apparatus according to claim 10, wherein:

the carriage includes a contact section; and the cam mechanism includes a cam section and a lever which makes a contact with the contact section of the carriage and tilts the cam section, when the carriage is positioned at the maintenance section.

12. The image recording apparatus according to claim 10, wherein when the carriage is moved from the maintenance section to an image recording area at which the image recording section performs a recording of the image, the moving unit moves the spur holder in a direction such that the spur makes a contact with the paper discharging roller.

13. The image recording apparatus according to claim 9, wherein the moving unit is an actuator which makes the spur holder to move away from the paper discharging roller, when the carriage is positioned at the maintenance section.

14. The image recording apparatus according to claim 9, further comprising:

a motor; and a pair of resist rollers arranged on an upstream side of the carriage in the transportation direction of the recording medium, and including a drive roller and a driven roller;

wherein both of the drive roller and the paper discharging roller are driven by the motor.

15. The image recording apparatus according to claim 14, wherein the maintenance section is also driven by the motor.

16. The image recording apparatus according to claim 15, further comprising an actuator which separates the driven roller away from the drive roller, or weakens a pressing force of the driven roller against the drive roller;

wherein when the carriage is positioned at the maintenance section and when a maintenance is performed, the actuator is driven to separate the driven roller away from the drive roller, or to weaken the pressing force of the driven roller against the drive roller.

17. The image recording apparatus according to claim 16, further comprising:

a feeding roller which is driven by the motor and which feeds the recording medium by separating the recording medium from another recording medium; and a motive-power transmission switching mechanism which transmits the motive power by switching the motive power to one of the feeding roller and the maintenance section.

* * * * *